US011613839B2

(12) United States Patent
Bixby et al.

(10) Patent No.: US 11,613,839 B2
(45) Date of Patent: Mar. 28, 2023

(54) LAUNDRY TREATING APPLIANCE HAVING A HANGING BAR

(71) Applicant: WHIRLPOOL CORPORATION, Benton Harbor, MI (US)

(72) Inventors: Seth E. Bixby, Stevensville, MI (US); Sayer J. Murphy, Saint Joseph, MI (US); Giuseppe Netti, Osmate (IT); Jeremy D. Watkins, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 545 days.

(21) Appl. No.: 16/721,114

(22) Filed: Dec. 19, 2019

(65) Prior Publication Data

US 2021/0189634 A1 Jun. 24, 2021

(51) Int. Cl.
*D06F 58/18* (2006.01)

(52) U.S. Cl.
CPC ..... *D06F 58/18* (2013.01)

(58) Field of Classification Search
CPC ..... D06F 58/18; D06F 58/20; D06F 39/14; D06F 57/12; D06F 57/125
USPC ..... 223/69; 34/239
See application file for complete search history.

(56) References Cited

U.S. PATENT DOCUMENTS

| | | | | |
|---|---|---|---|---|
| 5,019,126 | A * | 5/1991 | Post | A47G 25/0685 211/100 |
| 9,752,270 | B2 | 9/2017 | Chae et al. | |
| 2020/0032443 | A1* | 1/2020 | Ekbundit | D06F 39/14 |
| 2020/0398102 | A1* | 12/2020 | Lindsay | A63B 21/00181 |

FOREIGN PATENT DOCUMENTS

| | | | | |
|---|---|---|---|---|
| CN | 102899850 | A * | 1/2013 | |
| CN | 102899850 | A | 1/2013 | |
| CN | 203953492 | U * | 11/2014 | |
| CN | 103911777 | B | 8/2015 | |
| CN | 208235169 | U * | 12/2018 | D06F 57/08 |
| DE | 4105112 | A1 | 8/1992 | |
| GB | 964789 | A | 7/1964 | |
| JP | 2013000244 | A | 1/2013 | |
| JP | 5819668 | B2 | 11/2015 | |
| KR | 950033350 | A | 12/1995 | |

OTHER PUBLICATIONS https://www.amazon.com/Honey-Can-Do-HNG-01519-Hanger-Holder-Folding/dp/B005W9V5VM (Year: 2015).*

* cited by examiner

*Primary Examiner* — John P McCormack
(74) *Attorney, Agent, or Firm* — McGarry Bair PC

(57) ABSTRACT

A laundry treating appliance for treating laundry items according to an automatic cycle of operation can include a cabinet defining an interior and having an access opening to the interior. A cover is movable between a closed position and an opened position to selectively open or close the access opening and has an inner surface confronting the access opening when the cover is in the closed position. A hanging bar is coupled to the cover.

20 Claims, 20 Drawing Sheets

LAUNDRY TREATING APPLIANCE HAVING A HANGING BAR

BACKGROUND

Laundry treating appliances, such as clothes washers, clothes dryers, washing machines, refreshers, and non-aqueous systems, can have a configuration based on a container, such as a laundry basket or drum that defines a drum opening, which may or may not rotate, and that at least partially defines a treating chamber in which laundry items are placed for treating. The laundry treating appliance can have a controller that implements a number of user-selectable, pre-programmed cycles of operation having one or more operating parameters. Hot water, cold water, or a mixture thereof, along with various treating chemistries, or detergents, can be supplied to the treating chamber in accordance with the cycle of operation.

The laundry treating appliance can include a cabinet including a panel with an access opening through which laundry items can be loaded and unloaded into the treating chamber. A closure, door assembly, or lid can be movably mounted to the cabinet to selectively open and close the access opening to the treating chamber. The laundry treating appliance can further include a variety of features to provide increased utility to the laundry treating appliance. One example of such a utility feature for the laundry treating appliance includes a hanging bar for hanging laundry items that is coupled to the laundry treating appliance.

BRIEF SUMMARY

In one aspect, the present disclosure relates to a laundry treating appliance for treating laundry items according to an automatic cycle of operation, the laundry treating appliance comprising a cabinet defining an interior and having an access opening to the interior, a cover movable between a closed position and an opened position to selectively open or close the access opening and having an inner surface confronting the access opening when the cover is in the closed position, and a hanging bar having a rod with opposite ends, a leg extending from each end, and the legs movably coupled to the cover for movement of the hanging bar between a storage position, where the hanging bar is adjacent the cover, and a use position, where the hanging bar extends from the cover.

DETAILED DESCRIPTION

Figure 1:
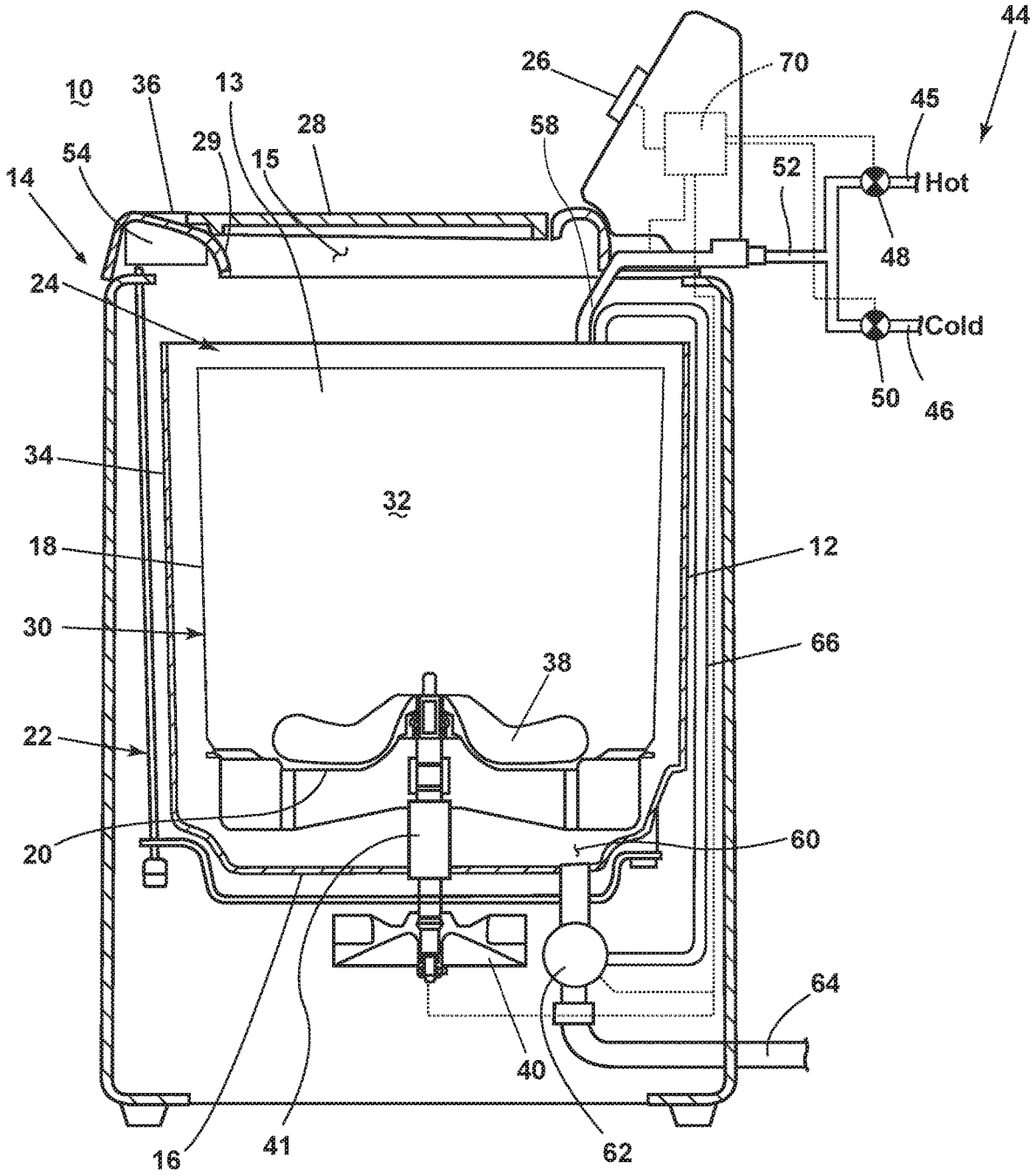
FIG. 1 is a schematic cross-sectional view of a laundry treating appliance including a cabinet and a cover in a closed position relative to the cabinet.

FIG. 1 illustrates a schematic view of a laundry treating appliance 10 according to aspects of the present disclosure. The laundry treating appliance 10 can be any laundry treating appliance 10 that performs a cycle of operation, such as an automatic cycle of operation, to clean or otherwise treat laundry items placed therein, non-limiting examples of which include a horizontal or vertical axis clothes washer; a clothes dryer; a combination washing machine and dryer; a dispensing dryer; a tumbling or stationary refreshing/revitalizing machine; an extractor; a non-aqueous washing apparatus; and a revitalizing machine. While the laundry treating appliance 10 is illustrated herein as a vertical axis, top-load laundry treating appliance 10, the aspects of the present disclosure can have applicability in laundry treating appliances with other configurations. The laundry treating appliance 10 shares many features of a conventional automated clothes washer and/or dryer, which will not be described in detail herein except as necessary for a complete understanding of the exemplary aspects in accordance with the present disclosure.

Laundry treating appliances are typically categorized as either a vertical axis laundry treating appliance or a horizontal axis laundry treating appliance. As used herein, the term "horizontal axis" laundry treating appliance refers to a laundry treating appliance having a rotatable drum that rotates about a generally horizontal axis relative to a surface that supports the laundry treating appliance. The drum can rotate about the axis inclined relative to the horizontal axis, with fifteen degrees of inclination being one example of the inclination. Similar to the horizontal axis laundry treating appliance, the term "vertical axis" laundry treating appliance refers to a laundry treating appliance having a rotatable drum that rotates about a generally vertical axis relative to a surface that supports the laundry treating appliance. However, the rotational axis need not be perfectly vertical to the surface. The drum can rotate about an axis inclined relative to the vertical axis, with fifteen degrees of inclination being one example of the inclination.

In another aspect, the terms vertical axis and horizontal axis are often used as shorthand terms for the manner in which the appliance imparts mechanical energy to the laundry, even when the relevant rotational axis is not absolutely vertical or horizontal. As used herein, the "vertical axis" laundry treating appliance refers to a laundry treating appliance having a rotatable drum, perforate or imperforate, that holds fabric items and, optionally, a clothes mover, such as an agitator, impeller, nutator, and the like within the drum. The clothes mover can move within the drum to impart mechanical energy directly to the clothes or indirectly through wash liquid in the drum. The clothes mover can typically be moved in a reciprocating rotational movement. In some vertical axis laundry treating appliances, the drum rotates about a vertical axis generally perpendicular to a surface that supports the laundry treating appliance. However, the rotational axis need not be vertical. The drum may rotate about an axis inclined relative to the vertical axis.

As used herein, the "horizontal axis" laundry treating appliance refers to a laundry treating appliance having a rotatable drum, perforated or imperforate, that holds laundry items and washes and/or dries the laundry items. In some horizontal axis laundry treating appliances, the drum rotates about a horizontal axis generally parallel to a surface that supports the laundry treating appliance. However, the rotational axis need not be horizontal. The drum can rotate about an axis inclined or declined relative to the horizontal axis. In horizontal axis laundry treating appliances, the clothes are lifted by the rotating drum and then fall in response to gravity to form a tumbling action. Mechanical energy is imparted to the clothes by the tumbling action formed by the repeated lifting and dropping of the clothes. Vertical axis and horizontal axis machines are best differentiated by the manner in which they impart mechanical energy to the fabric articles.

Regardless of the axis of rotation, a laundry treating appliance can be top-loading or front-loading. In a top-loading laundry treating appliance, laundry items are placed into the drum through an access opening in the top of a cabinet, while in a front-loading laundry treating appliance laundry items are placed into the drum through an access opening in the front of a cabinet. If a laundry treating appliance is a top-loading horizontal axis laundry treating appliance or a front-loading vertical axis laundry treating appliance, an additional access opening is located on the drum.

In more detail, the laundry treating appliance 10 can include a structural support assembly comprising a cabinet 14, which defines a housing and an interior, within which a laundry holding assembly resides. The cabinet 14 can be a housing having a chassis and/or a frame, to which decorative panels can or cannot be mounted, defining an interior, enclosing components typically found in a conventional laundry treating appliance, such as an automated clothes washer or dryer, which can include motors, pumps, fluid lines, controls, sensors, transducers, and the like. Such components will not be described further herein except as necessary for a complete understanding of the present disclosure.

The laundry holding assembly of the illustrated exemplary laundry treating appliance 10 can include a rotatable basket 30 having an open top 13 that can be disposed within the interior of the cabinet 14 and can at least partially define a rotatable treating chamber 32 for receiving laundry items for treatment and an access opening 15. The access opening 15 can provide access to the treating chamber 32. The treating chamber 32 is configured to receive a laundry load comprising laundry items for treatment, including, but not limited to, a hat, a scarf, a glove, a sweater, a blouse, a shirt, a pair of shorts, a dress, a sock, and a pair of pants, a shoe, an undergarment, and a jacket.

The open top 13 can be aligned with the access opening 15. A tub 34 can also be positioned within the cabinet 14 and can define an interior 24 within which the basket 30 can be positioned. The tub 34 can also at least partially define at least a portion of the treating chamber 32. The tub 34 can have a generally cylindrical side or tub peripheral wall 12 closed at its bottom end by a base 16 that can at least partially define a sump 60. The tub 34 can be at least partially aligned with the access opening 15 and the open top 13. In one example, the tub 34, the basket 30, along with the open top 13, and the access opening 15, can have central axes that are co-axial with one another, or with at least one of the other axes, such that a common central axis is formed.

The basket 30 can have a generally peripheral side wall 18, which is illustrated as a cylindrical side wall, closed at the basket end by a basket base 20 to further at least partially define the treating chamber 32. The basket 30 can be rotatably mounted within the tub 34 for rotation about a vertical basket axis of rotation and can include a plurality of perforations (not shown), such that liquid can flow between the tub 34 and the rotatable basket 30 through the perforations (not shown). While the illustrated laundry treating appliance 10 includes both the tub 34 and the basket 30, with the basket 30 at least partially defining the treating chamber 32, it is also within the scope of the present disclosure for the laundry holding assembly to include only one receptacle, such as the tub 34, without the basket 30, with the receptacle defining the laundry treating chamber 32 for receiving the load to be treated.

The cabinet 14 can further define a top wall or top panel 36, which can comprise a shroud 29 or to which the shroud 29 can be coupled. The shroud 29 can define at least a portion of the access opening 15, such that the shroud 29 can at least partially encircle the access opening 15. The shroud 29 can curve downwards toward the treating chamber 32 to direct laundry items into the basket 30. The shroud 29 can overlie a portion of the basket 30 such that the laundry items do not fall between the basket 30 and the tub 34.

A selectively openable closure or cover, illustrated herein as comprising a lid 28, can be movably mounted to or coupled to the cabinet 14 for selective movement between an opened position (FIG. 3) and a closed position, as shown, to selectively open and close the access opening 15, respectively, and to selectively provide access into the laundry treating chamber 32 through the access opening 15 of the basket 30. In one example, the lid 28 can be rotatable between the closed position and the opened position relative to the cabinet 14. By way of non-limiting example, the lid 28 can be hingedly coupled to the cabinet 14 for movement between the opened position and the closed position. At least one hinge assembly 90 (FIG. 3), illustrated herein as a pair of hinge assemblies 90, can couple the top panel 36 with the lid 28. In the closed position, the lid 28 can seal against at least one of the access opening 15, the top panel 36, or the shroud 29 and can at least partially confront the treating chamber 32 when the lid 28 closes the access opening 15. In the opened position, the lid 28 can be spaced apart from the access opening 15, the top panel 36, or the shroud 29 and can allow access to the top panel 36 and the access opening 15.

A laundry mover 38 can be rotatably mounted within the basket 30 to impart mechanical agitation to a load of laundry items placed in the basket 30. The laundry mover 38 can be oscillated or rotated about its vertical axis of rotation during a cycle of operation in order to produce load motion effective to wash the load contained within the treating chamber 32. Other exemplary types of laundry movers include, but are not limited to, an agitator, a wobble plate, and a hybrid impeller/agitator.

The basket 30 and the laundry mover 38 can be driven, such as to rotate within the tub 34, by a drive assembly 40 that includes a motor 41, which can include a gear case, operably coupled with the basket 30 and laundry mover 38. The motor 41 can be a brushless permanent magnet (BPM) motor having a stator (not shown) and a rotor (not shown). Alternately, the motor 41 can be coupled to the basket 30 through a belt and a drive shaft to rotate the basket 30, as is known in the art. Other motors, such as an induction motor or a permanent split capacitor (PSC) motor, can also be used. The motor 41 can rotate the basket 30 at various speeds in either rotational direction about the vertical axis of rotation during a cycle of operation, including at a spin speed wherein a centrifugal force at the inner surface of the basket side wall 18 is 1 g or greater. Spin speeds are commonly known for use in extracting liquid from the laundry items in the basket 30, such as after a wash or rinse step in a treating cycle of operation. A loss motion device or clutch (not shown) can be included in the drive assembly 40 and can selectively operably couple the motor 41 with either the basket 30 and/or the laundry mover 38.

A suspension assembly 22 can dynamically hold the tub 34 within the cabinet 14. The suspension assembly 22 can dissipate a determined degree of vibratory energy generated by the rotation of the basket 30 and/or the laundry mover 38 during a treating cycle of operation. Together, the tub 34, the basket 30, and any contents of the basket 30, such as liquid and laundry items, define a suspended mass for the suspension assembly 22.

The laundry treating appliance 10 can further include a liquid supply assembly to provide liquid, such as water or a combination of water and one or more wash aids, such as detergent, into the treating chamber 32 for use in treating laundry items during a cycle of operation. The liquid supply assembly can include a water supply 44 configured to supply hot or cold water. The water supply 44 can include a hot water inlet 45 and a cold water inlet 46. A valve assembly can include a hot water valve 48, a cold water valve 50, and various conduits 52, 58 for selectively distributing the water supply 44 from the hot water and cold water inlets 45, 46. The valves 48, 50 are selectively openable to provide water from a source of water, such as from a household water supply (not shown) to the conduit 52. A second water conduit, illustrated as the water inlet 58, can also be fluidly coupled with the conduit 52 such that water can be supplied directly to the treating chamber 32 through the open top of the basket 30. The water inlet 58 can be configured to dispense water, and optionally treating chemistry, into the tub 34 in a desired pattern and under a desired amount of pressure. For example, the water inlet 58 can be configured to dispense a flow or stream of treating chemistry or water into the tub 34 by gravity, i.e. a non-pressurized stream. The valves 48, 50 can be opened individually or together to provide a mix of hot and cold water at a selected temperature. While the valves 48, 50 and conduit 52 are illustrated exteriorly of the cabinet 14, it will be understood that these components can be internal to the cabinet 14.

A treating chemistry dispenser 54 can be provided for dispensing treating chemistry to the basket 30 for use in treating the laundry items according to a cycle of operation, either directly or mixed with water from the water supply 44. The treating chemistry dispenser 54 can be a single use dispenser, a bulk dispenser, or a combination of or an integrated single use and bulk dispenser, in non-limiting examples, and is fluidly coupled to the treating chamber 32. While the treating chemistry dispenser 54 is illustrated herein as being provided at the top panel 36 or the shroud 29, it will be understood that other locations for the treating chemistry dispenser 54 can be contemplated, such as at a different location within the cabinet 14. Further, the treating chemistry dispenser 54 can be provided in a drawer configuration or as at least one reservoir fluidly coupled to the treating chamber 32.

The treating chemistry dispenser 54 can include means for supplying or mixing detergent to or with water from the water supply 44. Alternatively, water from the water supply 44 can also be supplied to the tub 34 through the treating chemistry dispenser 54 without the addition of a detergent. The treating chemistry dispenser 54 can be configured to dispense the treating chemistry or water into the tub 34 in a desired pattern and under a desired amount of pressure. For example, the treating chemistry dispenser 54 can be configured to dispense a flow or stream of treating chemistry or water into the tub 34 by gravity, i.e. a non-pressurized stream.

The treating chemistry dispenser 54 can include multiple chambers or reservoirs fluidly coupled to the treating chamber 32 for receiving doses of different treating chemistries. The treating chemistry dispenser 54 can be implemented as a dispensing drawer that is slidably received within the cabinet 14, or within a separate dispenser housing which can be provided in the cabinet 14. The treating chemistry dispenser 54 can be moveable between a fill position, where the treating chemistry dispenser 54 is exterior to the cabinet 14 and can be filled with treating chemistry, and a dispense position, where the treating chemistry dispenser 54 is interior of the cabinet 14.

Non-limiting examples of treating chemistries that can be dispensed by the dispensing assembly during a cycle of operation include one or more of the following: water, detergents, surfactants, enzymes, fragrances, stiffness/sizing agents, wrinkle releasers/reducers, softeners, antistatic or electrostatic agents, stain repellents, water repellents, energy reduction/extraction aids, antibacterial agents, medicinal agents, vitamins, moisturizers, shrinkage inhibitors, and color fidelity agents, and combinations thereof. The treating chemistries can be in the form of a liquid, powder, or any other suitable phase or state of matter.

Additionally, the liquid supply assembly and treating chemistry dispenser 54 can differ from the configuration shown, such as by inclusion of other valves, conduits, wash aid dispensers, heaters, sensors, such as water level sensors and temperature sensors, and the like, to control the flow of treating liquid through the laundry treating appliance 10 and for the introduction of more than one type of detergent/wash aid.

A liquid recirculation and drain assembly can be provided with the laundry treating appliance 10 for recirculating liquid from within the laundry holding assembly and draining liquid from the laundry treating appliance 10. Liquid supplied to the tub 34 or into the treating chamber 32 through the water inlet 58 and/or the treating chemistry dispenser 54 typically enters a space between the tub 34 and the basket 30 and can flow by gravity to the sump 60. More specifically, the sump 60 can be located in and formed in part by the bottom of the tub 34 and the liquid recirculation assembly can be configured to recirculate treating liquid from the sump 60 onto the top of a laundry load located in the treating chamber 32.

A pump 62 can be housed below the tub 34 and can have an inlet fluidly coupled with the sump 60 and an outlet configured to fluidly couple and to direct liquid to either or both a household drain 64, which can drain the liquid from the laundry treating appliance 10, or a recirculation conduit 66. In this configuration, the pump 62 can be used to drain or recirculate wash water in the sump 60. As illustrated, the recirculation conduit 66 can be fluidly coupled with the treating chamber 32 such that it supplies liquid from the recirculation conduit 66 into the open top of the basket 30. The recirculation conduit 66 can introduce the liquid into the basket 30 in any suitable manner, such as by spraying, dripping, or providing a steady flow of liquid. In this manner, liquid provided to the tub 34, with or without treating chemistry can be recirculated into the treating chamber 32 for treating the laundry within. The liquid recirculation and drain assembly can include other types of recirculation assemblies.

It is noted that the illustrated drive assembly, suspension assembly, liquid supply assembly, recirculation and drain assembly, and dispensing assembly are shown for exemplary purposes only and are not limited to the assemblies shown in the drawings and described above. For example, the liquid supply and recirculation and pump assemblies can differ from the configuration shown in FIG. 1, such as by inclusion of other valves, conduits, sensors (such as liquid level sensors and temperature sensors), and the like, to control the flow of liquid through the laundry treating appliance 10 and for the introduction of more than one type of treating chemistry. For example, the liquid supply assembly can be configured to supply liquid into the interior of the basket 30 or into the interior of the tub 34 not occupied by the basket 30, such that liquid can be supplied directly to the tub 34 without having to travel through the basket 30. In another example, the liquid supply assembly can include a single valve for controlling the flow of water from the household water source. In another example, the recirculation and pump assembly can include two separate pumps for recirculation and draining, instead of the single pump 62 as previously described.

The laundry treating appliance 10, and specifically the liquid supply and/or recirculation and drain assemblies, can be provided with a heating assembly (not shown), which can include one or more devices for heating laundry and/or to heat liquid provided to the treating chamber 32 as part of a cycle of operation, such as, for example, a steam generator, which can be any suitable type of steam generator, such as a flow through steam generator or a tank-type steam generator, and/or a sump heater. Alternatively, the sump heater can be used to generate steam in place of or in addition to the steam generator. In one example, the heating assembly can include a heating element provided in the sump 60 to heat liquid that collects in the sump 60. Alternatively, the heating assembly can include an in-line heater that heats the liquid as it flows through the liquid supply, dispensing and/or recirculation assemblies.

The laundry treating appliance 10 can further include a control assembly, illustrated herein as a controller 70, for controlling the operation of the laundry treating appliance 10 and coupled with various working components of the laundry treating appliance 10 to control the operation of the working components and to implement one or more treating cycles of operation. The control assembly can include the controller 70 located within the cabinet 14 and a user interface 26 that can be operably coupled with the controller 70. The user interface 26 can provide an input and output function for the controller 70.

The user interface 26 can include one or more knobs, dials, switches, displays, touch screens and the like for communicating with the user, such as to receive input and provide output. For example, the displays can include any suitable communication technology including that of a liquid crystal display (LCD), a light-emitting diode (LED) array, or any suitable display that can convey a message to the user. The user can enter different types of information including, without limitation, cycle selection and cycle parameters, such as cycle options. Other communications paths and methods can also be included in the laundry treating appliance 10 and can allow the controller 70 to communicate with the user in a variety of ways. For example, the controller 70 can be configured to send a text message to the user, send an electronic mail to the user, or provide audio information to the user either through the laundry treating appliance 10 or utilizing another device such as a mobile phone.

The controller 70 can include the machine controller and any additional controllers provided for controlling any of the components of the laundry treating appliance 10. For example, the controller 70 can include the machine controller and a motor controller. Many known types of controllers can be used for the controller 70. It is contemplated that the controller is a microprocessor-based controller that implements control software and sends/receives one or more electrical signals to/from each of the various working components to implement the control software. As an example, proportional control (P), proportional integral control (PI), and proportional derivative control (PD), or a combination thereof, a proportional integral derivative control (PID), can be used to control the various components of the laundry treating appliance 10.

Figure 2:
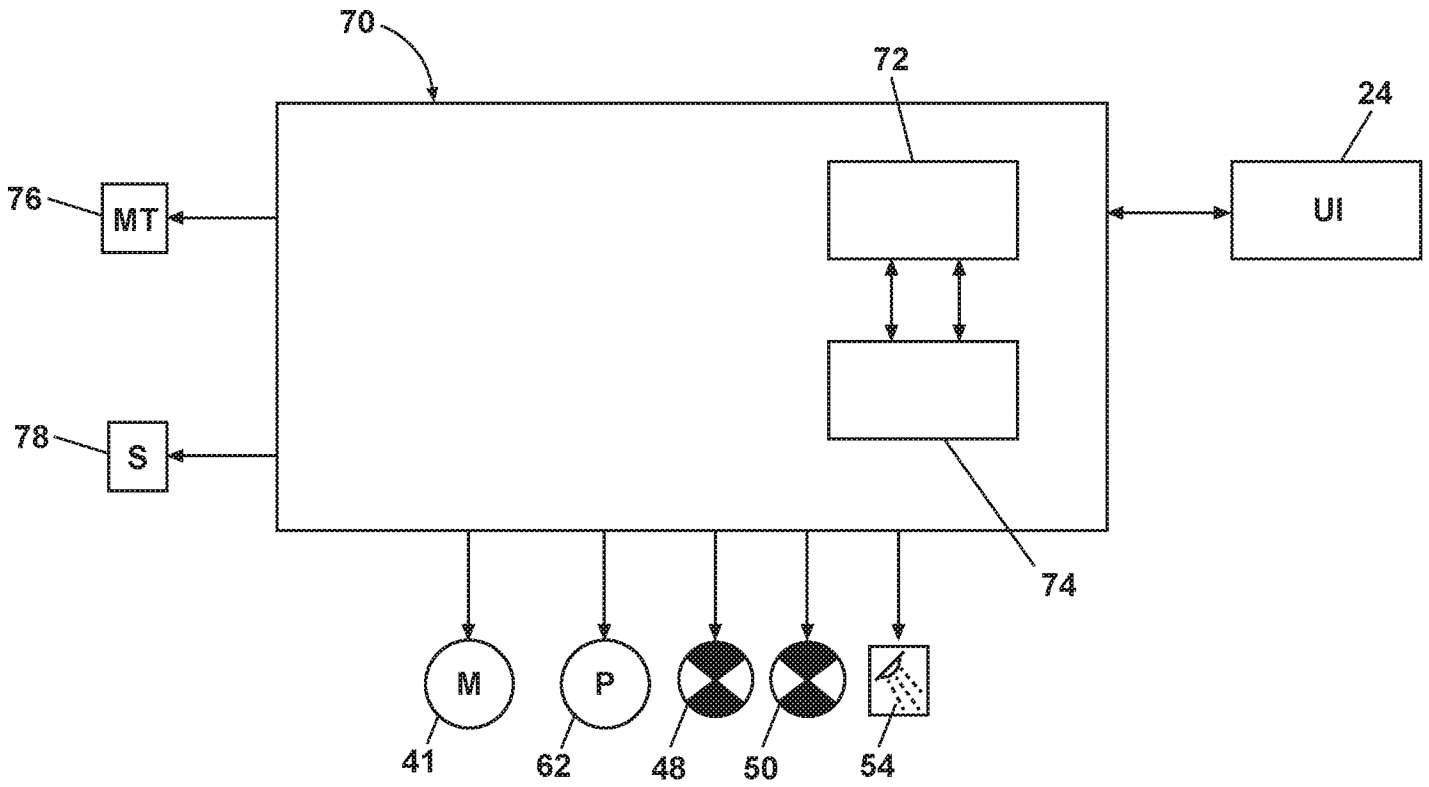
FIG. 2 is a schematic representation of a control assembly for controlling the operation of the laundry treating appliance of FIG. 1.

As illustrated in FIG. 2, the controller 70 can be provided with a memory 72 and a central processing unit (CPU) 74. The memory 72 can be used for storing the control software that can be executed by the CPU 74 in completing a cycle of operation using the laundry treating appliance 10 and any additional software. For example, the memory 72 can store a set of executable instructions including at least one user-selectable cycle of operation. Examples, without limitation, of treating cycles of operation include: wash, heavy duty wash, delicate wash, quick wash, pre-wash, refresh, rinse only, and timed wash, which can be selected at the user interface 26. The memory 72 can also be used to store information, such as a database or table, and to store data received from the one or more components of the laundry treating appliance 10 that can be communicably coupled with the controller 70. The database or table can be used to store the various operating parameters for the one or more cycles of operation, including factory default values for the operating parameters and any adjustments to them by the control assembly or by user input.

The controller 70 can be operably coupled with one or more components of the laundry treating appliance 10 for communicating with and/or controlling the operation of the components to complete a cycle of operation. For example, the controller 70 can be coupled with the hot water valve 48, the cold water valve 50, and the dispenser 54 for controlling the temperature and flow rate of treating liquid into the treating chamber 32; the pump 62 for controlling the amount of treating liquid in the treating chamber 32 or sump 60; the drive assembly 40 at the motor 41 for controlling the direction and speed of rotation of the basket 30 and/or the laundry mover 38; the user interface 26 for receiving user selected inputs and communicating information to the user; and the heater assembly to control the operation of these and other components to implement one or more of the cycles of operation.

The controller 70 can also receive input from a temperature sensor 76, such as a thermistor, which can detect the temperature of the treating liquid in the treating chamber 32 and/or the temperature of the treating liquid being supplied to the treating chamber 32. The controller 70 can also be coupled with one or more sensors 78 provided in one or more of the assemblies of the laundry treating appliance 10 to receive input from the various additional sensors 78, which are known in the art and not shown for simplicity. Non-limiting examples of additional sensors 78 that can be communicably coupled with the controller 70 include a weight sensor, a moisture sensor, a chemical sensor, a position sensor, an imbalance sensor, a load size sensor, and a motor torque sensor, which can be used to determine a variety of assembly and laundry characteristics, such as laundry load inertia or mass.

Figure 3:
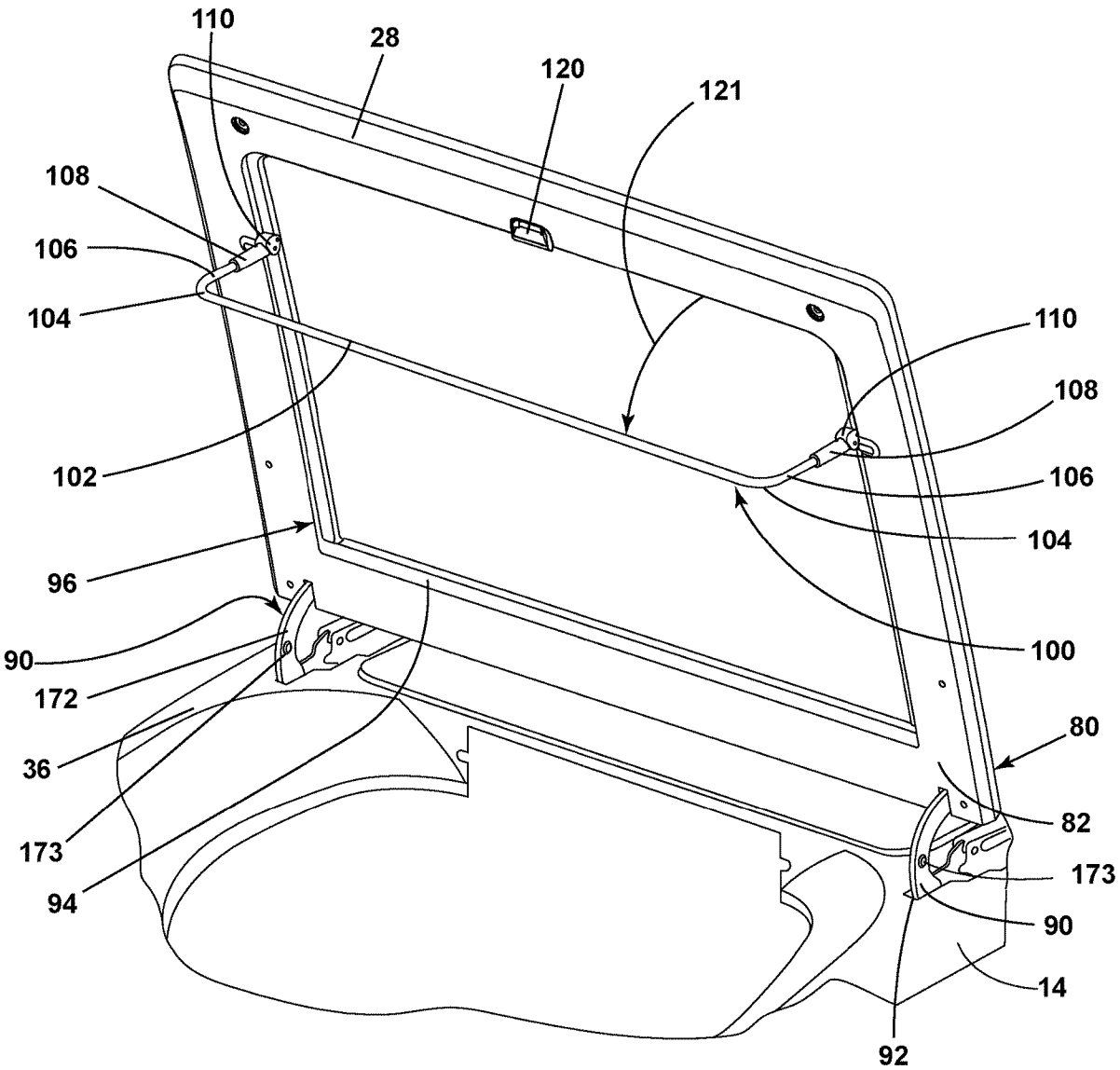
FIG. 3 is a perspective view of the cover of FIG. 1 in an opened position and including a hanging bar in a use position.

Referring now to FIG. 3, the lid 28 is shown in the opened position relative to the cabinet 14. When the lid 28 is in the closed position, the lid 28 can overlie and extend across the entire width and depth of the top panel 36, such as to form an edge-to-edge lid 28 and wherein the lid 28 can be provided entirely above the top panel 36, with no part of the lid 28 being provided in plane with or below the top panel 36. Alternatively, the lid 28 can be provided as, for example, an at least partially recessed lid wherein at least a portion of the lid 28 is recessed into the top panel 36 such that the top panel 36 surrounds and abuts at least a portion of a periphery of the lid 28. In either example, it will also be understood that the lid 28 can also overlie and extend across less than the entire width and the entire depth of the top panel 36. The lid 28 can comprise glass, metal, plastic, composite, or any other suitable material.

The lid 28 can further include a suitable closure assembly (not shown) to secure the lid 28 in the closed position. By way of non-limiting example, such a closure assembly can include a latch, a hook, or a snap mechanism provided on one of the lid 28 or the top panel 36 for selective engagement or coupling with the other of the lid 28 or the top panel 36. The closure assembly can be configured to resiliently retain the lid 28 in the closed condition until sufficient force is applied to overcome the coupling of the lid 28 with the top panel 36.

In one example, the lid 28 comprises an outer surface 80 and an inner surface 82 that can be vertically spaced from one another, such that the inner surface 82 at least partially confronts the treating chamber 32 and the access opening 15 when the lid 28 is in the closed position. The outer surface 80 and the inner surface 82 can be thought of as collectively forming a peripheral frame of the lid 28. It will be understood that the outer surface 80 and the inner surface 82 can extend across the entire width and depth of the lid 28, or the outer surface 80 and the inner surface 82 can be provided as the peripheral frame to surround, for example, a viewing window (not shown) within the lid 28. The hinge assemblies 90 can be positioned such that, when the lid 28 is in the closed position, the hinge assemblies 90 extend vertically above the inner surface 82, but are received below the outer surface 80 such that the outer surface 80 overlies at least a portion of the hinge assemblies 90 and the hinge assemblies 90 are hidden from view from the outside of the laundry treating appliance 10 when the lid 28 is in the closed position.

The at least one hinge assembly 90 rotatably couples the lid 28 with the top panel 36 and is coupled, mounted, or otherwise attached to both the lid 28 and the top panel 36. The top panel 36 of the cabinet 14 can define at least one hinge opening 92, such that at least a portion of the hinge assemblies 90 can protrude upwardly through the hinge opening 92 to couple with the lid 28, while the rest of the hinge assemblies 90 are received within the cabinet 14, below the top panel 36.

In one example, the at least one hinge assembly 90 can comprise first and second hinge assemblies 90, spaced laterally from one another such that the first hinge assembly 90 is positioned adjacent one edge of the lid 28 while the second hinge assembly 90 is positioned adjacent the opposite edge of the lid 28. In the case that first and second hinge assemblies 90 are provided opposite one another along edges of the lid 28, it is contemplated that the first and second hinge assemblies 90 can be provided as left and right hinge assemblies 90 that are structured so as to be flipped or mirror images to one another. It will be understood that the laundry treating appliance 10 can include any suitable number of hinge assemblies 90, including a single hinge assembly 90. While the lid 28 is illustrated herein as rotating about an axis of rotation at the rear of the top panel 36, it will be understood that the lid 28 can be configured to rotate about a rotation axis provided along any edge of the lid 28 and the top panel 36, such as the front or side.

Figure 4:
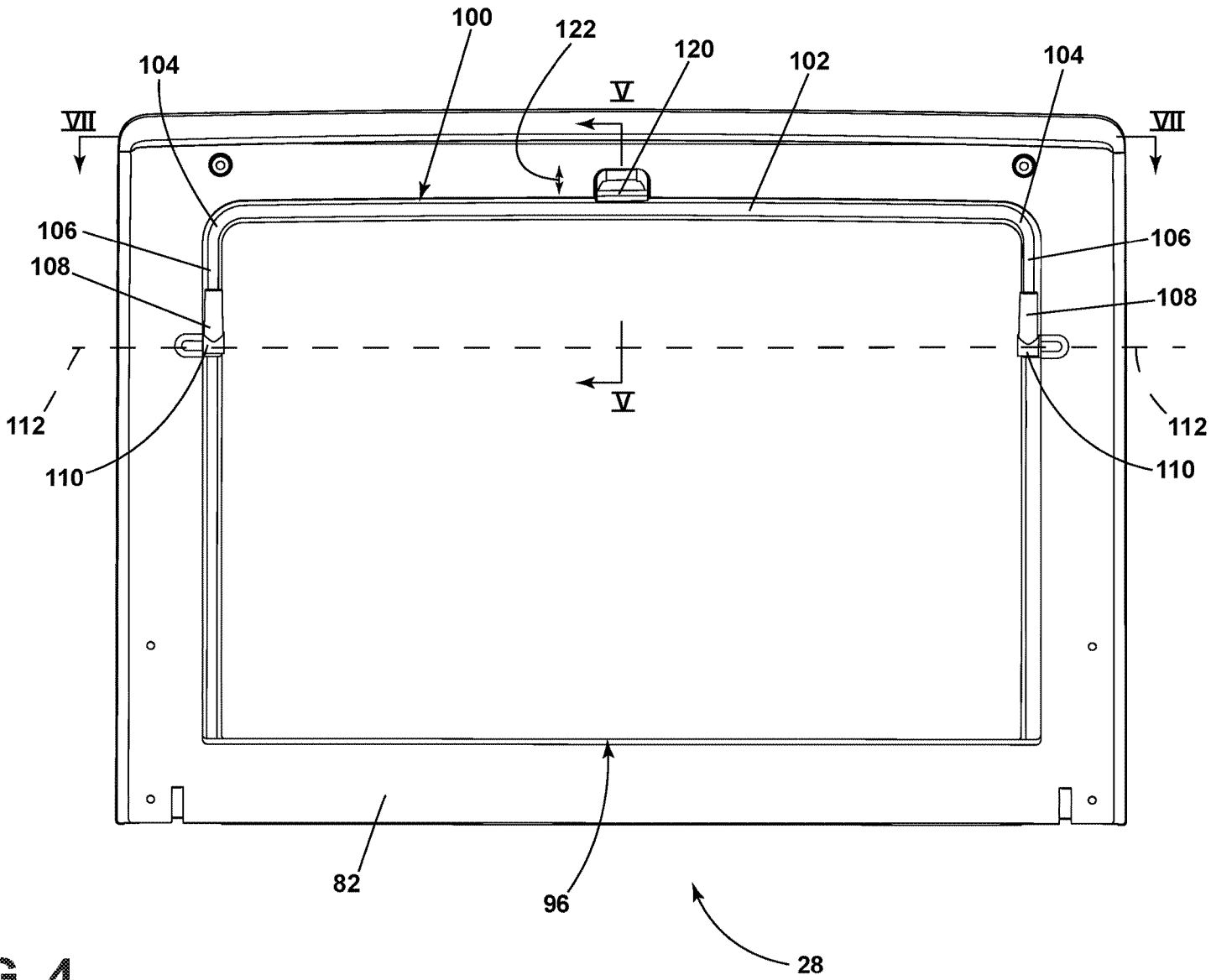
FIG. 4 is a bottom view of the cover of FIG. 3 with the hanging bar in a storage position and coupled with a retaining element in a retaining position.

A hanging bar 100 is coupled to and carried by the inner surface 82 of the lid 28 for movement relative to the lid 28 between a use position as shown and a storage position (FIG. 4). In the use position, the hanging bar 100 extends outwardly away from the lid 28, and in particular from the inner surface 82, such as, by way of non-limiting example, by extending from the inner surface 82 in a direction so as to at least partially overlie the treating chamber 32 and the access opening 15. In one example, the hanging bar 100 can extend generally orthogonally from the inner surface 82 and the lid 28 in the use position, though it will be understood that the use position is not limited to such an angle or direction. In a further example and as shown, the lid 28 and the hanging bar 100 can be sized and positioned such that the hanging bar 100 at least partially overlies the treating chamber 32 and the access opening 15 when the hanging bar 100 is in the use position and the lid 28 is in the opened position.

In the storage position, the hanging bar 100 can be adjacent the lid 28 such that the hanging bar 100 extends along, such as parallel to or substantially parallel to, and confronts the inner surface 82. The hanging bar 100 can also at least partially overlie the treating chamber 32 and the access opening 15 when the hanging bar 100 is in the storage position, either only when the lid 28 is in the closed position, or both when the lid 28 is in the closed position and the opened position. In one example, the hanging bar 100 can be movably coupled to the inner surface 82 of the lid 28 for pivoting or rotational movement between the storage position and the use position.

The hanging bar 100 comprises a rod 102 having opposing ends 104 with a leg 106 extending from each of the opposing ends 104. In one example, the legs 106 can extend substantially orthogonally away from the rod 102. The legs 106 can be movably coupled, such as rotatably coupled, to the inner surface 82 for movement of the hanging bar 100 between the storage position and the use position. In one example, the legs 106 can be thought of as being coupled to the peripheral frame defined by the inner surface 82 and the outer surface 80. As illustrated herein, a coupling element 108 can be provided between each leg 106 and the inner surface 82 such that the coupling elements 108 mount the legs 106 and the hanging bar 100 to the inner surface 82 for movement relative thereto. The coupling elements 108 can at least partially receive the legs 106 and can each include a coupling end 110 that couples to the inner surface 82 for the rotational movement of the hanging bar 100 between the use and the storage positions.

The lid 28 can include a retaining element 120 positioned and configured to retain the hanging bar 100, and in particular the rod 102, when the hanging bar 100 is in the storage position. The retaining element 120 can be provided on or recessed into the inner surface 82 so long as it is positioned at a height such that it can contact and retain the rod 102 when the hanging bar 100 is in the storage position. The retaining element 120 can be movable or actuatable relative to the lid 28 for movement between a retaining position, where the retaining element 120 retains the hanging bar 100, and a release position, where the retaining element 120 does not retain the hanging bar 100. In one example, the hanging bar 100 can be biased toward the use position. In this case, when the retaining element 120 is in the retaining position, the retaining element 120 contacts the rod 102 to retain or bear against the rod 102, against the biasing force, when the hanging bar 100 is in the storage position. When the retaining element 120 is in the release position and does not contact or retain the rod 102, the hanging bar 100 is not prevented from being biased outwardly from the lid 28 as in the direction of the arrow 121 to move from the storage position to the use position. In a further example, the retaining element 120 can be biased toward the retaining position such that the retaining element 120 must be deflected, actuated, or otherwise moved to the release position in order to release the rod 102 from engagement with the retaining element 120.

The inner surface 82 can include an inner lip 94 that extends upwardly from the inner surface 82 and can define a recess 96 within the inner surface 82, such that when the lid 28 is in the closed position, the recess 96 extends upwardly from the inner surface 82 and inwardly into the vertical height of the lid 28. In one example, the hanging bar 100 is provided within the periphery of the recess 96 defined by the inner lip 94 such that at least a portion of the hanging bar 100 is recessed into the lid 28. In one example, the hanging bar 100, and specifically the legs 106 and the rod 102 are entirely received within the recess 96, such that the inner lip 94 surrounds the periphery of the hanging bar 100 when the hanging bar 100 is in the storage position. By providing the hanging bar 100 within the recess 96, the retaining element 120 can then be positioned to retain the hanging bar 100 in the storage position without the retaining element 120 protruding downwardly from or beyond the inner surface 82.

Turning now to FIG. 4, the hanging bar 100 is shown in the storage position relative to the lid 28. The hanging bar 100 is entirely received within the recess 96 and is retained in the storage position by engagement with the retaining element 120. As illustrated herein, the retaining element 120 in the retaining position extends downwardly from the inner surface 82 in front of the rod 102, at least partially confronting or overlying the rod 102, to prevent outward movement of the rod 102 from the lid 28. The retaining element 120 is moveable relative to the lid 28 in a direction as shown by the arrow 122 to be moved between the retaining position and the release position. When the lid 28 is in the opened position as shown, the lid is positioned generally vertically, such that an upward vertical movement of the retaining element 120 would move the retaining element 120 from the retaining position to the release position.

The structure of the coupling elements 108 can be seen in further detail as shown, such that the coupling ends 110 of the coupling elements 108 are each rotatably coupled to the lid 28 and define an axis of rotation 112 about which the hanging bar 100 rotates between the storage position and the use position. As the legs 106 are received within the coupling elements 108 and extending to the coupling ends 110, the legs 106 can be thought of as being rotatably coupled to the lid 28, such as via the coupling elements 108, to at least partially define the axis of rotation 112 about which the hanging bar 100 rotates between the storage position and the use position.

Figure 5:
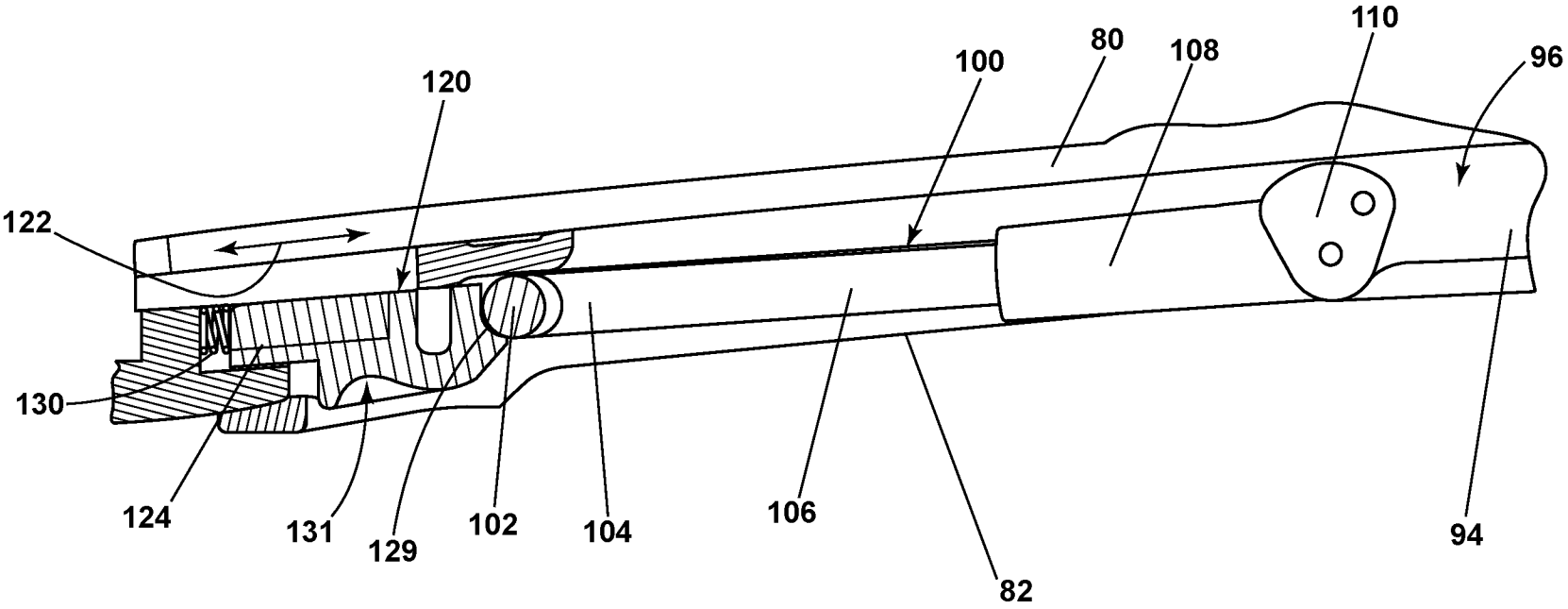
FIG. 5 is a cross-sectional view of the hanging bar and the retaining element taken along line V-V of FIG. 4.

Turning now to FIG. 5, the hanging bar 100 and the retaining element 120 can be seen in cross section. As described previously, the inner lip 94 extends upwardly from the inner surface 82 and into the vertical height of the lid 28 to define a recess 96 within which the hanging bar 100 can be at least partially received. The retaining element 120 can also be at least partially recessed into the lid 28 and can be defined by a body 124 that couples to the lid 28. A biasing element 130, illustrated herein as a spring 130, can be at least partially received within or can bear against the body 124. Thus, while the retaining element 120 is slidingly movable between the retaining position and the release position, the biasing element 130 bears against the retaining element 120 to bias the retaining element 120 toward the retaining position. The retaining element 120 further defines a retaining surface 129 that can abut, bear against, and at least partially receive the hanging bar 100, and particularly the rod 102, when the hanging bar 100 is in the storage position and the retaining element 120 is in the retaining position. The retaining element 120 further still defines an indentation 131 that can be provided for allowing a user to grasp or actuate the retaining element 120, such as by placing a thumb or a finger within the indentation 131 to move the retaining element 120 from the retaining position to the release position.

Figure 6:
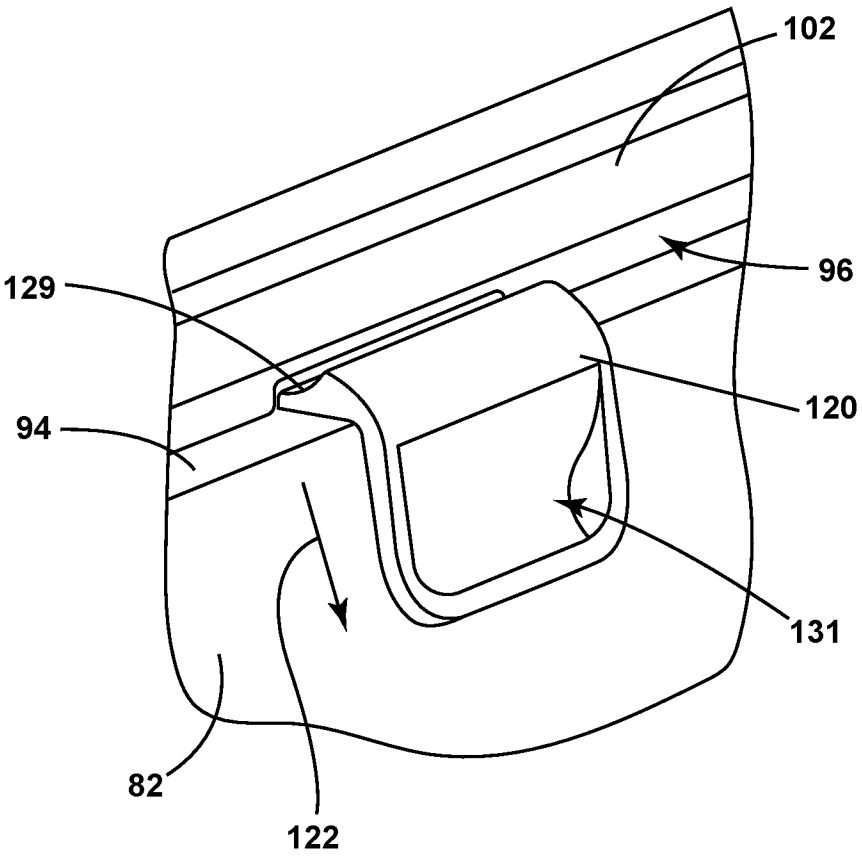
FIG. 6 is a perspective view of the hanging bar and the retaining element of FIG. 5 with the retaining element in a release position.

Referring now to FIG. 6, the retaining element 120 is illustrated in the release position relative to the rod 102. In the release position, the retaining element 120 is positioned to be spaced from the rod 102, deflected or actuated against the force of the biasing element 130 of the retaining element 120 in the direction of the arrow 122 to move along the lid 28, such as by a user applying pressure against the indentation 131 by a finger or a thumb and in the direction of the arrow 122. With the retaining element 120 in the release position, the retaining surface 129 is removed from contact with the rod 102 such that the rod 102 does not bear against the retaining element 120 and is not prevented from being biased away from the storage position and away from the retaining element 120 into the use position.

Figure 7:
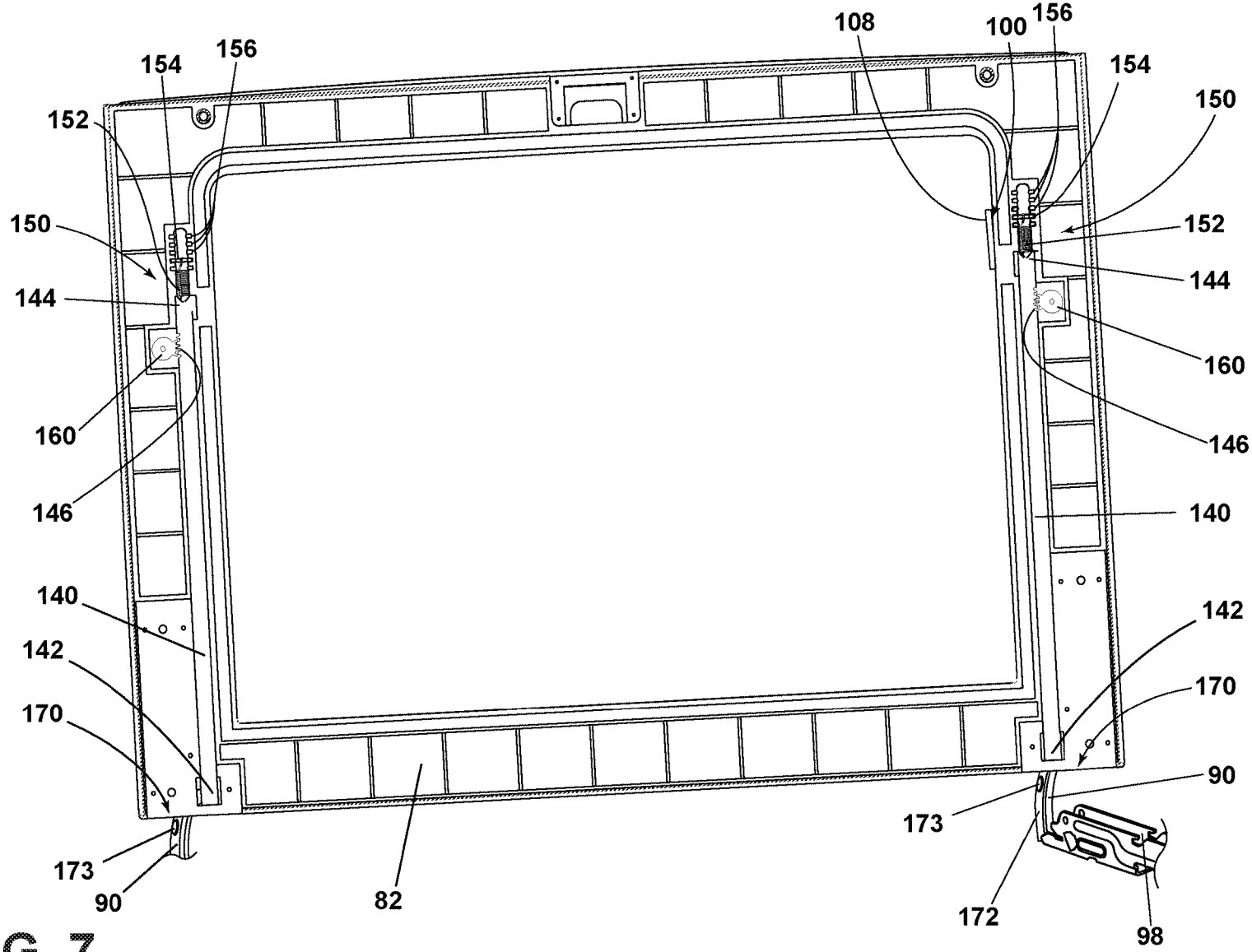
FIG. 7 is a cross-sectional view of the cover taken along line VII-VII of FIG. 4 and including a locking assembly and a biasing assembly.

Turning now to FIG. 7, the lid 28 further comprises at least one biasing assembly 150, illustrated herein as a pair of biasing assemblies 150, and at least one locking assembly 170, illustrated herein as a pair of locking assemblies 170, both the biasing assemblies 150 and the locking assemblies 170 operably coupled to the hanging bar 100. While the lid 28 is illustrated herein as including the pair of biasing assemblies 150 and the pair of locking assemblies 170, such that one of the biasing assemblies 150 and one of the locking assemblies 170 are provided and coupled with each of the legs 106, it will be understood that the lid 28 could comprise only one biasing assembly 150 and only one locking assembly 170 coupled with only one of the legs 106. The interior of the lid 28, and specifically the side of the inner surface 82 that confronts the outer surface 80, opposite the side of the inner surface 82 on which the hanging bar 100 is provided, carries or is coupled to the biasing assemblies 150 and the locking assemblies 170. The hanging bar 100 is provided on the opposite side of the inner surface 82 from the view as shown, and is positioned on the opposite side of the inner surface 82 so as to be generally at least partially aligned with or adjacent to the biasing assemblies 150.

At least one linking element 140, illustrated herein as a pair of linking elements 140, extend along at least a portion of the inner surface 82, such that the linking elements 140 extend along at least a portion of the recess 96 or a periphery of the recess 96, and also extend between the biasing assemblies 150 and the locking assemblies 170. In one example, one linking element 140 is provided along or adjacent to each of a pair of opposing sides of the recess 96, each of the linking elements 140 generally aligned with and extending between one of the hinge assemblies 90 and one of the opposing ends 104 or legs 106 of the hanging bar 100, though it will be understood that only a single linking element 140 can be provided with the lid 28, such as by being provided only at one side of the lid 28.

Each linking element 140 has opposing ends 142, 144, which can be illustrated herein as a first end 142 and a second end 144. Each first end 142 is positioned adjacent to and is movably coupled to one of the hinge assemblies 90 to at least partially form one of the locking assemblies 170. Each first end 142 is further directly operably coupled with a locking element 172, such that each locking assembly 170 comprises at least one of the linking elements 140, one of the hinge assemblies 90, and one of the locking elements 172, to at least partially collectively form each of the locking assemblies 170.

The opposite end of each of the linking elements 140, at the second end 144, is positioned adjacent to and operably coupled with each of the biasing assemblies 150, as well as with the hanging bar 100 that is provided on the opposite side of the inner surface 82. Each second end 144 is directly operably coupled with the hanging bar 100, and in particular with each of the coupling ends 110. Each biasing assembly 150 comprises at least a biasing element 152, illustrated herein as a spring 152, a pin 154, a set of receiving grooves 156, the second end 144, a damper 160, and a toothed portion 146 defined by the linking element 140.

Figure 8:
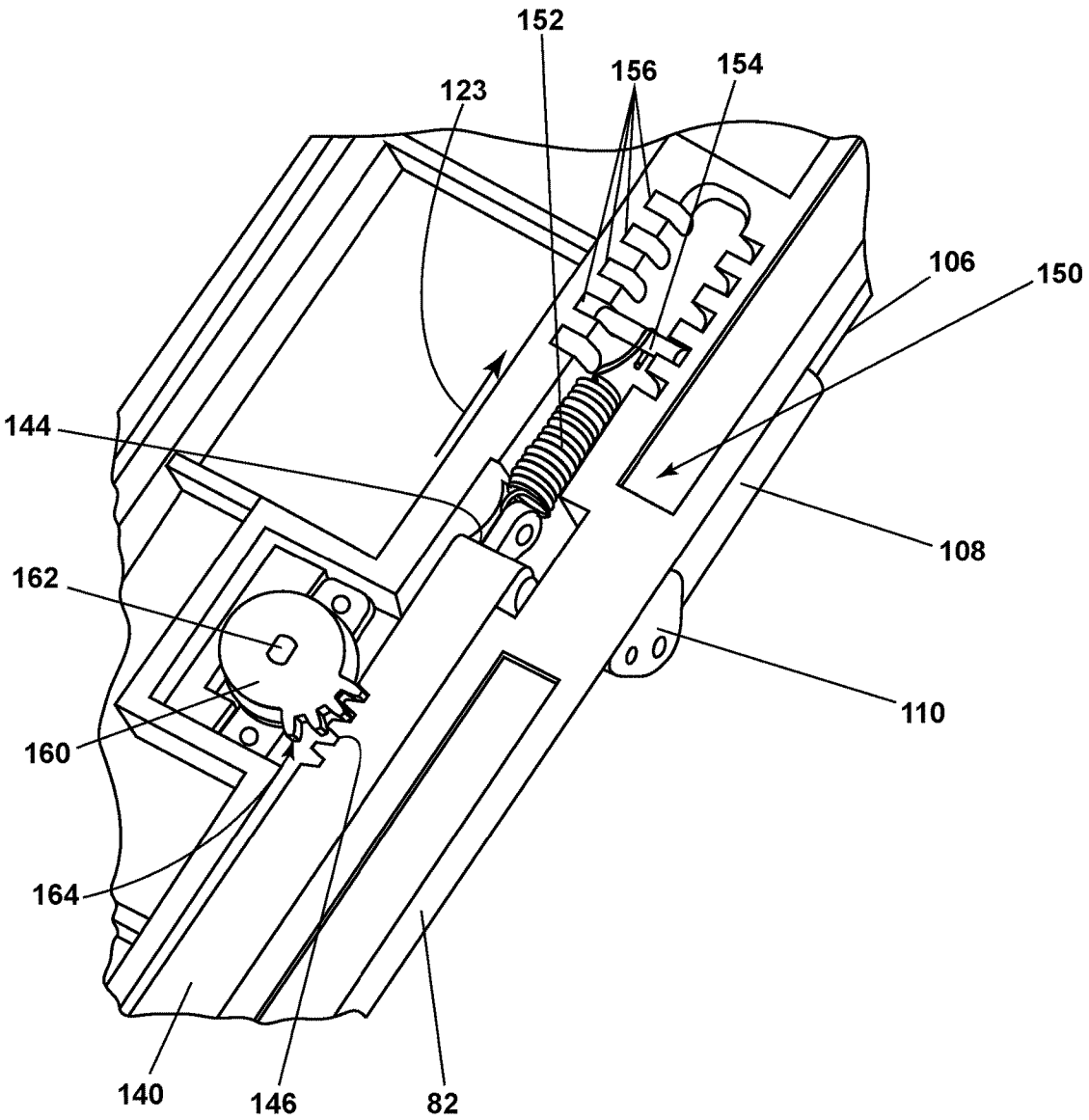
FIG. 8 is an enlarged view of the cross-section of the biasing assembly of FIG. 7 and shown with the hanging bar in the storage position.

Referring now to FIG. 8, the details of the components of one of the biasing assemblies 150 can be better seen in an enlarged view. As shown, the hanging bar 100 is in the storage position, with the other components of the biasing assembly 150 in corresponding storage positions, or a storage configuration, as determined by the storage position of the hanging bar 100. The set of receiving grooves 156 can be sized and shaped so as to selectively receive the pin 154. As used herein, the term set can be used to describe any suitable number of receiving grooves 156, including only a single receiving groove 156. As illustrated herein, the set of receiving grooves 156 can comprise multiple receiving grooves 156 provided at varying positions. Specifically, the multiple receiving grooves 156 are provided at varying distances from the second end 144 in the storage position such that the pin 154 can be provided within any one of the receiving grooves 156 to be positioned at a suitable or selected distance from the second end 144 in the storage position. In one example, the biasing element 152 is coupled to the pin 154, such that the positions of the receiving grooves 156 at varying distances from the second end 144 allow flexibility to accommodate biasing elements 152 having a variety of biasing forces exerted. Specifically, the pin 154 can be moved between the receiving grooves 156 of varying distances in order to accommodate biasing elements 152 of varying strengths and sizes.

The biasing element 152 extends between and is coupled to both the second end 144 of the linking element 140, as well as to the pin 154. With the biasing assembly 150 in the storage position or storage configuration as shown, the biasing element 152 is at least partially extended or stretched between the pin 154 and the second end 144, such that the biasing element 152 exerts a biasing force inwardly against and between the pin 154 and the linking element 140, to effectively pull the pin 154 and the linking element 140 toward one another. When the pin 154 is received within one of the receiving grooves 156, the pin 154 is stationary and is prevented from movement towards the linking element 140 due to its receipt within the receiving groove 156. Because the biasing element 152 is prevented from effecting movement of the pin 154, the biasing force of the biasing element 152 when at least partially extended instead acts to pull against the linking element 140 and thus to bias the linking element 140 toward the pin 154 in the direction indicated by the arrow 123. The further coupling of the second end 144 with the coupling end 110 of the hanging bar 100 further operably couples the biasing element 152 with the hanging bar 100. In one example, the biasing of the linking element 140 toward the pin 154 by the force of the biasing element 152 in turn opposingly biases the hanging bar 100 toward the use position.

The damper 160 is configured to damp movement of the linking element 140 relative to the damper 160, such that the damper 160 provides a damping force to counter or damp the biasing force of the biasing element 152. The damper 160 can provide the damping force in a direction that opposes the biasing force of the biasing element 152. The damper 160 is illustrated herein as essentially a wheel 160 having an axis of rotation 162 about which the damper 160 rotates. The axis of rotation 162 can be provided as and defined by any suitable structure to retain the damper 160 and about which the damper 160 can rotate, such as, by way of non-limiting example, being illustrated herein a pin 162 or a rib 162. The damper 160 further includes a toothed portion 164. The toothed portion 164 can project or extend outwardly from the wheel 160, away from the axis of rotation 162. The linking element 140 defines a corresponding toothed portion 146 that can selectively mesh with the toothed portion 164 of the damper 160 to damp movement of the linking element 140 relative to the damper 160, and in opposition to the biasing force of the biasing element 152. While the damper 160 and the toothed portion 146 of the linking element 140 are illustrated herein as being positioned adjacent to the second end 144, it will be understood that the damper 160 and the corresponding toothed portion 146 can be provided at any suitable position along the length of the linking element 140.

Figure 9:
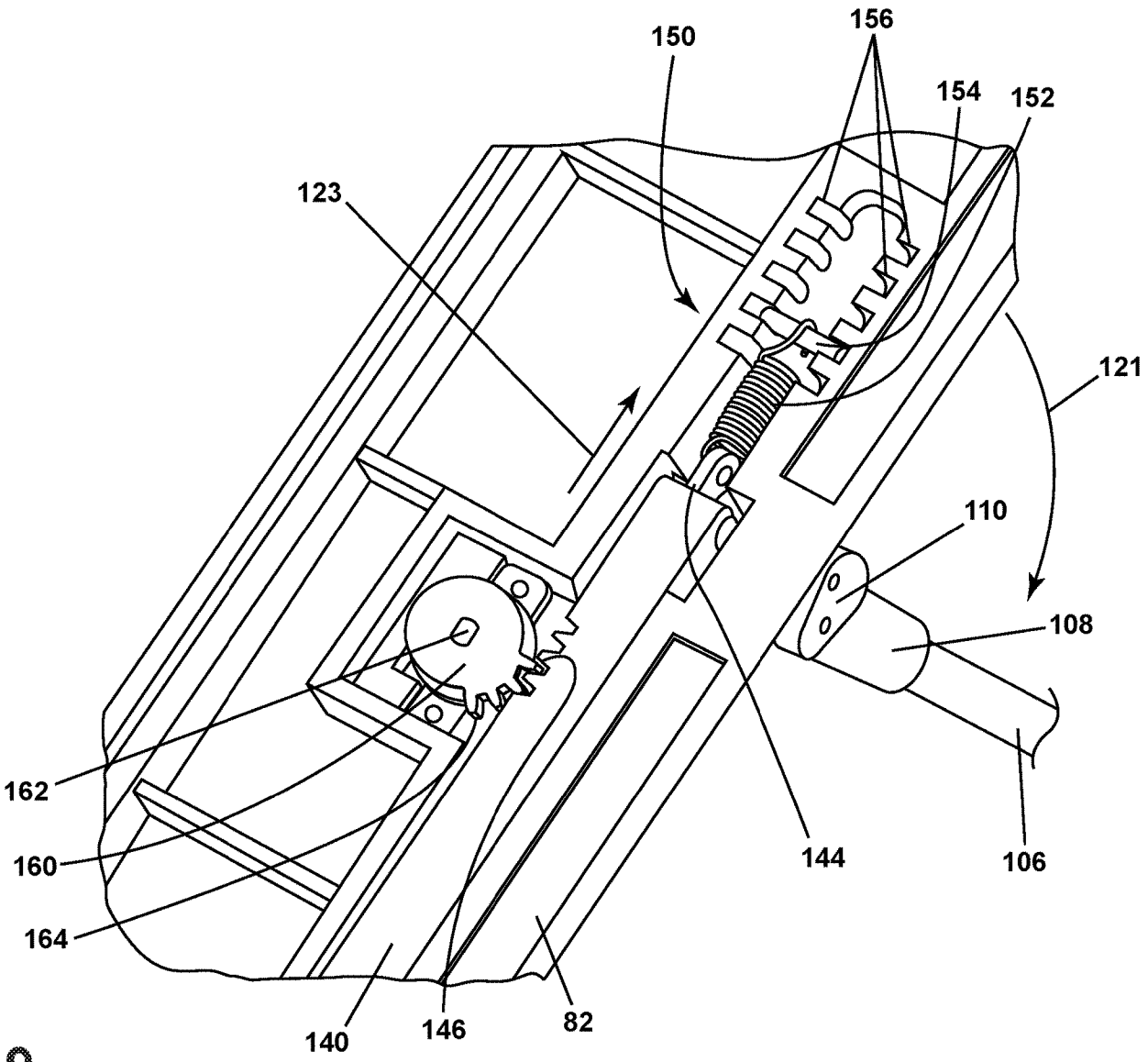
FIG. 9 is an enlarged view of the cross-section of the biasing assembly of FIG. 7 and shown with the hanging bar in the use position.

Referring now to FIG. 9, the components of the biasing assembly 150 are provided in a use position or a use configuration when the hanging bar 100 is in the use position as shown. In the use configuration, the linking element 140 is positioned closer to the pin 154 than in the storage configuration and in the direction of the arrow 123, such that the biasing element 154 is no longer extended or stretched between the pin 154 and the second end 144, or such that the biasing element 154 is less extended or stretched between the pin 154 and the second end 144 in the use configuration as compared to the storage configuration. As the linking element 140 is positioned closer to the pin 154 in the use configuration than the storage configuration, the second end 144 and the toothed portion 146 are also in different positions relative to the damper 160 than they were in the storage configuration. Specifically, in the use configuration, the second end 144 is further spaced from the damper 160 than in the storage configuration. Further, the toothed portion 146 of the linking element 140 is moved relative to the toothed portion 164 of the damper 160 as compared to the storage configuration. In one example, in the use configuration, the toothed portion 146 of the linking element 140 is positioned adjacent an opposite end of the damper 160 and the toothed portion 164 than the end of the toothed portion 164 of the damper 160 that the toothed portion 146 of the linking element 140 was adjacent in the storage configuration. In one example, relative to the storage configuration, the biasing element 152, the second end 144, the linking element 140, and the toothed portion 146 are moved in the direction of the arrow 123 with respect to the pin 154 and the damper 160.

Figure 10:
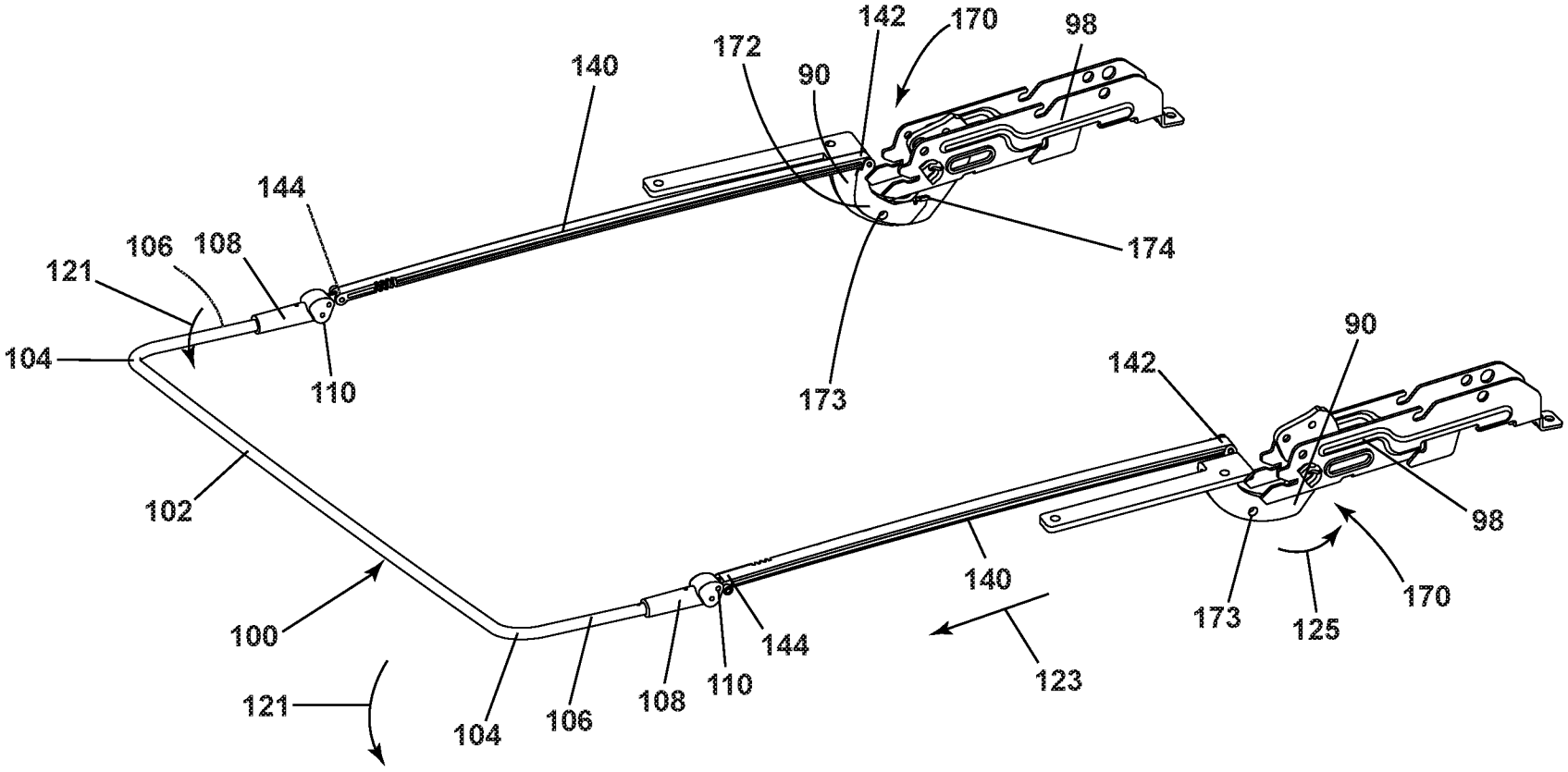
FIG. 10 is a perspective view of the hanging bar and the locking assembly of FIG. 7 with the cover removed and the hanging bar in the storage position.

Referring now to FIG. 10, with the inner surface 82 and the outer surface 80 of the lid 28 removed from view, the hanging bar 100, the linking elements 140, and the locking assemblies 170 are shown in a position or configuration corresponding to the lid 28 in the closed position and the hanging bar 100 in the storage position for a better view of the coupling of the lid 28 components. For example, the coupling of the hanging bar 100 with the linking elements 140 is shown. As illustrated, each of the legs 106 of the hanging bar 100 are coupled to each of the linking elements 140 at the second ends 144 via the coupling elements 108. Specifically, the coupling ends 110 of each of the coupling elements 108 are movably coupled to the second ends 144 of each of the linking elements 140. In one example, the coupling ends 110 are rotatably coupled with the second ends 144 such that the coupling ends 110 and the hanging bar 100 can rotate relative to the second ends 144 and relative to the linking elements 140 between the storage position and the use position of the hanging bar 100, such as for movement of the hanging bar 100 from the storage position to the use position in the direction of the arrow 121 relative to the linking elements 140.

The linking elements 140 are each further operably coupled with each of the locking assemblies 170. As illustrated, the first ends 142 of each of the linking elements 140 are coupled to each of the locking assemblies 170 via direct operable coupling with each of the locking elements 172. Specifically, the first ends 142 of each of the linking elements 140 are movably coupled to the locking elements 172 of each of the locking assemblies 170. In one example, each of the first ends 142 are rotatably coupled with each of the locking elements 172 such that the locking elements 172, and thus the locking assemblies 170, can rotate relative to the first ends 142 and relative to the linking elements 140 between an unlocked position as shown and a locked position (FIG. 12), such as for movement of the locking assemblies 170 from the unlocked position to the locked position by rotational movement of each of the locking elements 172 in the direction of the arrow 125 relative to the linking elements 140.

The first ends 142 of each of the linking elements 140 are further movably coupled relative to each of the hinge assemblies 90 via the direct operable coupling of each of the first ends 142 with each of the locking elements 172. Specifically, each of the locking elements 172 are in turn movably coupled relative to each of the hinge assemblies 90, such that each of the locking elements 172 are rotatable relative to each of the hinge assemblies 90 and each about a coupler 173, illustrated herein, by way of non-limiting example, as a coupling pin 173, between the locked and unlocked positions. Further yet, each of the hinge assemblies 90 are further movably coupled, such as rotatably coupled, relative to a hinge frame 98, such that each of the hinge assemblies 90 are rotatable relative to each of the hinge frames 98 between the opened and closed positions of the lid 28. In turn, each of the locking elements 172 are rotatable relative to each of the hinge frames 98 between the locked and unlocked positions. The hinge assemblies 90 can be thought of as comprising the hinge frames 98.

While the hanging bar 100 and each of the locking assemblies 170, and specifically each of the locking elements 172, are coupled to the linking elements 140 for rotational movement relative to the second ends 144 and the first ends 142, respectively, each of the linking elements 140 can further be configured for translational movement relative to the hanging bar 100, and specifically the coupling ends 110, and relative to each of the locking assemblies 170, and specifically the locking elements 172, between the storage configuration and the use configuration. In one example, each of the linking elements 140 can move from the storage configuration to the use configuration by translational movement of each of the linking elements 140 in the direction of the arrow 123 relative to the locking assemblies 170 and the hanging bar 100.

Figure 11:
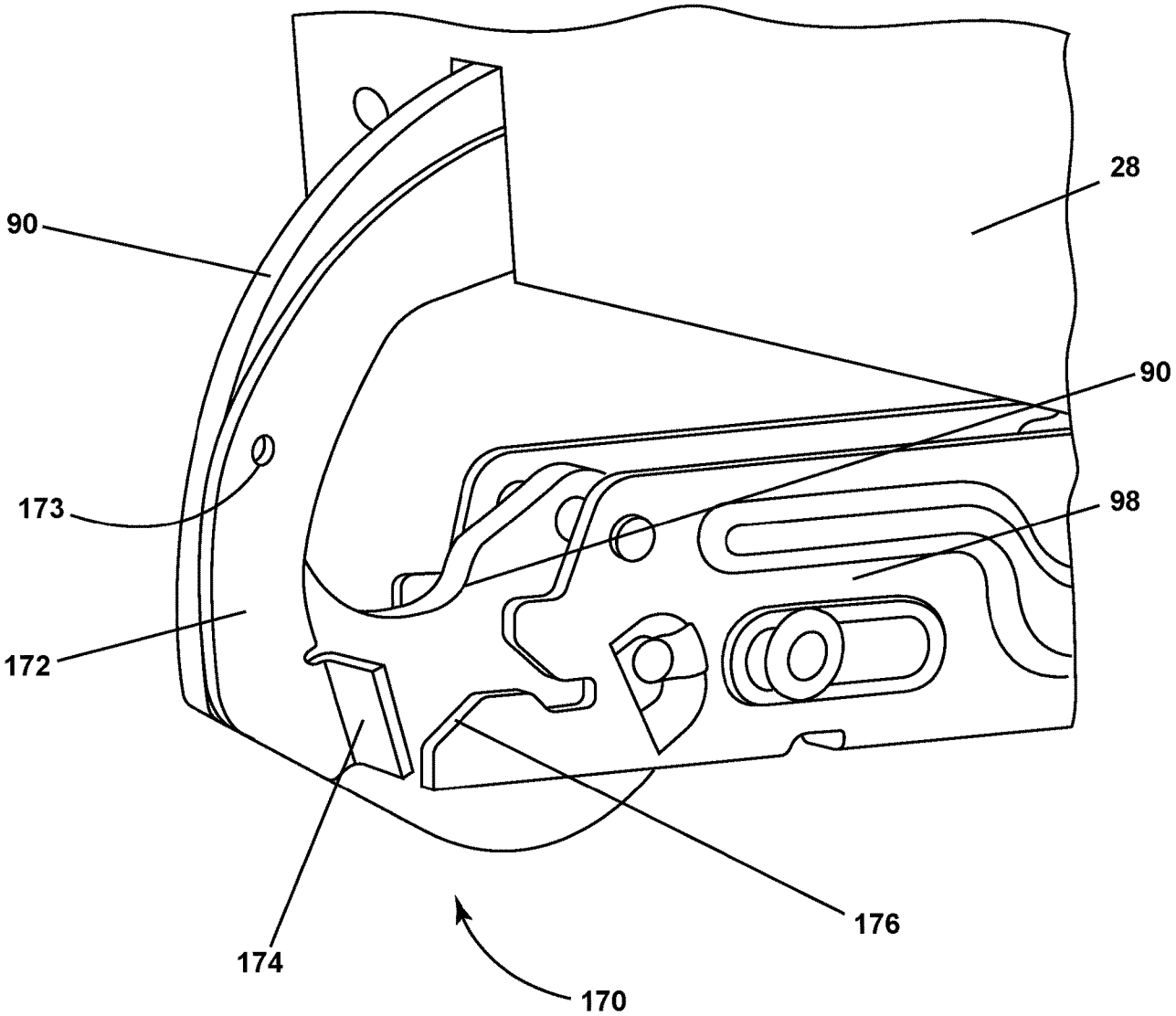
FIG. 11 is an enlarged perspective view of the locking assembly of FIG. 10 including a locking element shown in an unlocked position and with the cover in the opened position.

Referring now to FIG. 11, an enlarged view of one of the locking assemblies 170 is shown in the unlocked position, and corresponding to the hanging bar 100 in the storage position, as in FIG. 10, but with the lid 28 in the opened position relative to the hinge frame 98. The locking element 172 defines a locking flange 174 that extends substantially orthogonally from the plane of the locking element 172, and in particular extends inwardly from the locking element 172, away from the hinge assembly 90 to which the locking element 172 is coupled by the coupling pin 173, and toward the recess 96 and the opposing hinge assembly 90. The hinge frame 98 defines an engaging surface 176 that can be positioned and configured to selectively engage with the locking flange 174.

The unlocked position of the locking assembly 170, as shown, can be defined by the position of the locking element 172 relative to the hinge frame 98, and more specifically by the position of the locking flange 174 relative to the engaging surface 176. In the unlocked position, the locking element 172, particularly the locking flange 174, is spaced from the hinge frame 98, particularly the engaging surface 176, such that the locking flange 174 does not abut the engaging surface 176. When the hanging bar 100 is in the storage position, regardless of whether the lid 28 occupies the closed or the opened position, the locking assembly 170 and the locking element 172 are in the unlocked position such that the hinge assembly 90 can move freely relative to the hinge frame 98 for movement of the lid 28 between the opened and closed positions.

Figure 12:
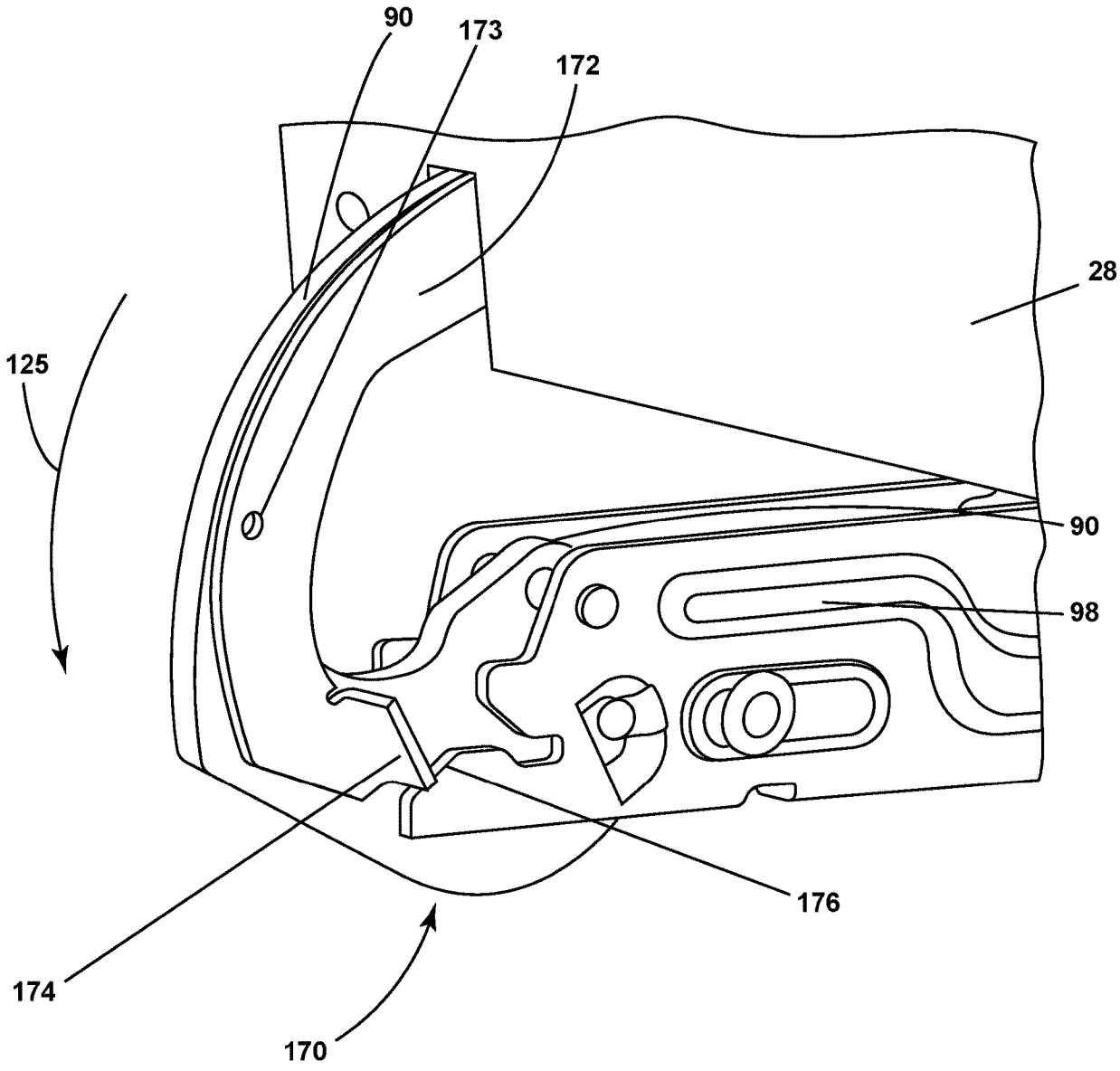
FIG. 12 is a perspective view of the locking assembly and the locking element of FIG. 11 with the locking element in a locked position and the cover in the opened position.

Referring now to FIG. 12, the locking assembly 170 is shown in the locked position, corresponding to the hanging bar 100 in the use position, and with the lid 28 in the opened position relative to the hinge frame 98. The locked position of the locking assembly 170, like the unlocked position, can be defined by the position of the locking element 172 relative to the hinge frame 98, and more specifically by the position of the locking flange 174 relative to the engaging surface 176. In the locked position, the locking element 172, and in particular the locking flange 174, is in contact with the hinge frame 98, particularly to abut and to bear against the engaging surface 176. In one example, in the locked position, the locking flange 174 bears against the engaging surface 176 such that the locking flange 174 at least partially overlies and rests on top of at least a portion of the engaging surface 176. When the locking flange 174 overlies and rests on the engaging surface 176, the weight of the lid 28 causes the locking flange 174 to bear against the engaging surface 176 due to gravity.

When the lid 28 is in the opened position and the hanging bar 100 is in the use position, the locking assembly 170 and the locking element 172 occupy the locked position such that the locking element 172 bears against the hinge frame 98 to prevent movement of the hinge assembly 90 relative to the hinge frame 98 in the direction of the arrow 125, in turn preventing the lid 28 from moving from the opened position to the closed position. Thus, the lid 28 is prevented from moving to the closed position when the hanging bar 100 is in the use position, corresponding to the locked position of the locking assembly 170 and the locking element 172. In this way, the bearing of the locking flange 174 against the engaging surface 176 holds the lid 28 in the opened position and prevents movement of the lid 28 to the closed position until the locking element 172 is removed from contact with the hinge frame 98, corresponding to the hanging bar 100 occupying the storage position.

Turning now to the operation of the hanging bar 100, one of the biasing assemblies 150, and one of the locking assemblies 170, when the hanging bar 100 is not in use, whether the lid 28 is in the closed or the opened position, the hanging bar 100 is held in the storage position of FIG. 4, against the lid 28, by the retaining element 120 in the retaining position engaging with the rod 102 to retain the hanging bar 100 in the storage position and prevent movement of the hanging bar 100 to the use position. Because the retaining element 120 is biased toward the retaining position by the biasing element 130, the hanging bar 100 is automatically retained in the storage position by default and without an action by a user to change the position of the hanging bar 100. When the hanging bar 100 is retained in the storage position, the biasing assembly 150, including the linking element 140, is likewise retained or held stationary in the storage configuration and prevented from moving to the use configuration. The stationary retention of the linking element 140 in the storage configuration in turn retains the locking assembly 170, including the locking element 172, in the unlocked position, prevented from moving to the locked position. The stationary retention of the locking element 172 in the unlocked position allows the hinge assembly 90 to move freely relative to the hinge frame 98 for movement of the lid 28 between the opened and closed positions.

In further detail with respect to the biasing assembly 150, when the hanging bar 100 is retained in the storage position by the retaining element 120, the biasing assembly 150 is retained in the storage configuration and is prevented from biasing the hanging bar 100 from the storage position to the use position. Specifically, when the hanging bar 100 is retained in the storage position, the biasing element 152 is at least partially extended or stretched between the pin 154 and the second end 144. In one example, during the manufacturing or assembly of the laundry treating appliance 10, the size and strength of the biasing element 152 and the positioning of the pin 154 within one of the receiving grooves 156 are selected specifically to ensure that the biasing element 152 is at least partially extended when the hanging bar 100 is held in the storage position. In this way, when the hanging bar 100 is in the storage position, extending the biasing element 152, the biasing element 152 exerts a biasing force such that the biasing element 152 pulls against the second end 144 of the linking element 140, biasing the linking element 140 toward the pin 154. However, despite the force exerted by the biasing element 152, since the hanging bar 100 is also coupled to the second end 144 at the coupling end 110, when the hanging bar 100 is stationary and held in place in the storage position by the retaining element 120, the second end 144 is likewise held stationary in place in the storage configuration by the hanging bar 100 and the coupling end 110. In this way, the linking element 140 is prevented from moving upwardly toward the pin 154 under the force of the biasing element 152, and relative movement between the components of the biasing assembly 150 is prevented from occurring.

In further detail with respect to the locking assembly 170, when the hanging bar 100 is retained in the storage position by the retaining element 120 and the biasing assembly 150 is retained in the storage configuration by the hanging bar 100, the locking assembly 170 is retained in the unlocked position and is prevented from moving from the unlocked position to the locked position. Specifically, when the biasing assembly 150 is retained in the storage configuration, the linking element 140 is held stationary in place relative to the lid 28, which in turn holds the locking element 172 stationary in place relative to the lid 28 and prevents movement of the locking element 172 relative to the lid 28. In one example, the linking element 140 and the locking element 172, and optionally also the coupling pin 173, are sized, positioned, and coupled specifically to ensure that the locking element 172 is held spaced from and not abutting the hinge frame 98 when the linking element 140 is held stationary in the storage configuration, retaining the locking assembly 170 in the unlocked position. In this way, unimpeded movement of the lid 28 between the closed and opened positions automatically occurs as a result of the retaining of the hanging bar 100 in the storage position by the retaining element 120, and will be continuously ensured, by default, until a user takes an action to change the position of the hanging bar 100.

When a user desires to use the hanging bar 100, such as to hang up a wet or soiled laundry item, actuation of the hanging bar 100 to the use position requires minimal effort by the user and can even be accomplished with a single hand by which the user can move or actuate the retaining element 120 from the retaining position to the release position. When the lid 28 is in the opened position, such that the hanging bar 100 and the retaining element 120 are accessible by the user, the user can simply use a single hand, finger, or thumb to bear against the indentation 131 to move or deflect the retaining element 120 upwardly away from the rod 102, pushing against and overcoming the biasing force exerted by the biasing element 130, to move the retaining element 120 from the retaining position to the release position in the direction of the arrow 122. When the retaining element 120 is moved into the release position, the retaining surface 129 is moved away from retaining engagement with the rod 102, releasing the hanging bar 100 from the retaining element 120.

With the retaining element 120 in the release position, the hanging bar 100 is no longer restrained or prevented from movement from the storage position to the use position and can thus be automatically biased or deflected outwardly from the lid 28 by the biasing assembly 150, past and away from the retaining element 120 and in the direction of the arrow 121, to move from the storage position to the use position.

Specifically, when the hanging bar 100 is no longer held stationary in the storage position by the retaining element 120, the second end 144, and thus the linking element 140, is similarly no longer held stationary in place by the hanging bar 100 and the coupling end 110 and prevented from movement relative to the pin 154. With the linking element 140 no longer held in place and prevented from movement relative to the lid 28, the biasing force exerted by the biasing element 152 against the second end 144 is permitted to and is sufficient to act on the linking element 140 to pull the linking element 140, and particularly the second end 144, toward the pin 154 in the direction of the arrow 123. As the biasing element 152 pulls the linking element 140 toward the pin 154, the biasing element 152 moves from the at least partially extended or stretched condition of the storage configuration toward a compressed or unextended condition, as illustrated in the use configuration of FIG. 9.

In one example, when the biasing element 152 has reached the fully compressed or unextended condition and is no longer extended or stretched by the pin 154 and the second end 144, the biasing element 152 ceases to exert the biasing force against the linking element 140, and further movement of the linking element 140 toward the pin 154 does not occur. While movement of the linking element 140 toward the pin 154 by the biasing element 152 is described herein as ceasing when the biasing element 152 reaches the fully compressed or unextended condition, it will be understood that further movement of the linking element 140 toward the pin 154 could cease prior to the biasing element 152 reaching the fully compressed or unextended condition. For example, prior to the biasing element 152 reaching the fully compressed or unextended condition, the biasing element 152 can reach a point at which, although not fully compressed or unextended, the biasing element 152 is sufficiently compressed such that the biasing force exerted is no longer sufficient to overcome the weight or the gravitational pull of the linking element 140, and further movement toward the pin 154 can cease at that point.

In this way, the force exerted on the linking element 140 by the biasing element 152 effects a translational movement of the linking element 140 in the direction of the arrow 123, toward the pin 154 and toward the retaining element 120. Because the second end 144 is further operably coupled with the coupling end 110 of the hanging bar 100, the translational movement of the linking element 140 toward the pin 154 and in the direction of the arrow 123 in turn correspondingly moves at least a portion of the coupling end 110 in the same direction of the arrow 123 to effect further corresponding movement of the coupling end 110 and the hanging bar 100 relative to the linking element 140. In one example, the translational movement of the linking element 140 and of the at least a portion of the coupling end 110 in the direction of the arrow 123 effects a corresponding rotational movement of the hanging bar 100, and specifically of the coupling end 110, about the axis of rotation 112, and from the storage position to the use position, in the direction of the arrow 121 in response to the translational movement of the linking element 140 into the use configuration.

In this way, the biasing of the linking element 140 toward the pin 154, and the resulting translational movement of the linking element 140 upwardly toward the pin 154, causes a corresponding biasing, which can be thought of as an opposing biasing or a counter-biasing, of the hanging bar 100 from the storage position to the use position, and the resulting rotational movement of the hanging bar 100 and the coupling end 110 about the axis of rotation 112, downwardly and away from the inner surface 82 in the direction of the arrow 121, toward the use position.

As the biasing element 152 exerts the biasing force and pulls the linking element 140 toward the pin 154, as well as correspondingly biasing the hanging bar 100 for rotational movement toward and into the use position, the translational movement of the linking element 140 also occurs relative to the damper 160. Further, the translational movement of the linking element 140 results in movement of the toothed portion 146 of the linking element 140 relative to the damper 160, and more specifically relative to the toothed portion 164 of the damper 160. In one example, the translational movement of the linking element 140 between the storage configuration and the use configuration is sufficient to move the toothed portion 146 of the linking element 140 entirely past the toothed portion 164 of the damper 160, though it will be understood that the toothed portion 146 of the linking element 140 could be moved only partially along or past the toothed portion 164 of the damper 160.

Regardless of the extent of the relative movement between the toothed portions 146, 164, as the linking element 140 moves between the storage configuration and the use configuration, the toothed portion 146 of the linking element 140 is at least partially brought into meshed engagement with the corresponding toothed portion 164 defined by the damper 160. The meshing movement of the teeth between or relative to the toothed portions 146, 164 of the linking element 140 and the damper 160, respectively, creates a frictional force between the teeth and/or between the toothed portions 146, 164. In one example, the toothed portions 146, 164 are sized and positioned specifically so as to generate a frictional force, which can be thought of as a damping force, that acts to oppose, to counter, or to damp, at least partially, the biasing force exerted on the linking element 140 by the biasing element 152. In this way, the meshed engagement between the toothed portions 146, 164 at least somewhat damps or slows the movement of the linking element 140 toward the pin 154, and thus also, in turn, the movement of the hanging bar 100 from the storage position to the use position. In this way, at least a portion of the biasing assembly 150 operates and acts to provide an effective soft open feature or function for the hanging bar 100 so that the hanging bar 100 is not slammed or abruptly propelled into the use position in a manner that is jarring or unpleasant to the user.

It will also be understood that the damper 160 and the toothed portions 146, 164 are optional and can be omitted from the lid 28 and the linking element 140. Instead of including the damper 160 and the toothed portions 146, 164, movement of the hanging bar 100 into the use position that may be perceived as too fast, too harsh, or too abrupt by users can instead be damped or mitigated by altering the biasing force of the biasing element 152, such as by using a more compliant spring 152 that exerts a biasing force that is weaker, or by the provision of any other suitable type of damper or soft open feature.

In addition to effecting the biasing of the hanging bar 100 for rotational movement toward and into the use position, and further in addition to creating a damping force in cooperation with the damper 160 to counter the biasing force exerted by the biasing element 152, the translational movement of the linking element 140 toward the pin 154 is further operably coupled with the locking assembly 170. Because the first end 142 is operably coupled with the locking element 172 of the locking assembly 170, and further because the locking element 172 is rotatably coupled with the hinge assembly 90 by the coupling pin 173, the translational movement of the linking element 140 toward the pin 154 and in the direction of the arrow 123 in turn correspondingly moves at least a portion of the locking element 172 in the same direction of the arrow 123 to effect further corresponding movement of the locking element 172 and the locking assembly 170 relative to the linking element 140 and to the coupling pin 173. In one example, the translational movement of the linking element 140 and of the at least a portion of the locking element 172 in the direction of the arrow 123 effects a corresponding rotational movement of the locking element 172 about the coupling pin 173, and further specifically of at least a portion of the locking element 172 that includes the locking flange 174, about the first end 142 and about the coupling pin 173, and from the unlocked position (FIG. 11) to the locked position (FIG. 12), in the direction of the arrow 125 in response to the translational movement of the linking element 140 into the use configuration.

In this way, the biasing of the linking element 140 toward the pin 154, and the resulting translational movement of the linking element 140 upwardly toward the pin 154, causes a corresponding biasing, which can be thought of as an opposing biasing or a counter-biasing, of the locking assembly 170 from the unlocked position to the locked position, and the resulting rotational movement of the locking element 172 and the locking flange 174 about axes of rotation defined by the first end 142 and by the coupling pin 173, and specifically of the locking flange 174 rearwardly and toward the inner surface 82 in the direction of the arrow 125, toward the locked position.

In further detail, prior to the movement of the biasing assembly 150 to the use configuration and the hanging bar 100 to the use position, the locking assembly 170 is retained in the unlocked position of FIG. 11, as previously described. In the unlocked position, the locking element 172 is spaced from and does not abut the hinge frame 98, and, more specifically, the locking flange 174 is spaced from and does not abut the engaging surface 176, allowing the hinge assembly 90 to move freely relative to the hinge frame 98 and the lid 28 to move freely between the closed and opened positions, in turn.

When the biasing assembly 150 is moved or biased into the use configuration and the hanging bar 100 is moved or biased into the use position, the translational movement of the linking element 140 toward the pin 154 and in the direction of the arrow 123, in a direction away from the locking assembly 170, correspondingly pulls the portion of the locking element 172 that couples to the first end 142 in the same direction of the arrow 123 and upwardly and away from the hinge frame 98. The travel of the at least a portion of the locking element 172 in the direction of the arrow 123, toward the pin 154, and upwardly and away from the hinge frame 98, is limited by the coupling of the locking element 172 to the coupling pin 173, and further to the hinge assembly 90 via the coupling pin 173. The locking element 172 is prevented from moving vertically relative to the coupling pin 173, such that the pulling of the portion of the locking element 172 that couples with the first end 142 upwardly and in the direction of the arrow 123 causes rotational movement of the locking element 172 from the unlocked position to the locked position in the direction of the arrow 125. Specifically, the locking element 172 is caused to rotate about the coupling pin 173, as well as relative to the first end 142, as the coupling of the locking element 172 and the first end 142 is pulled upwardly and away from the locking assembly 170. In this way, the portion of the locking element 172 that carries the locking flange 174 is correspondingly caused to rotate rearwardly and upwardly until the locking flange 174 abuts and bears against the engaging surface 176 in the locked position and further rotational movement of the locking element 172 is prevented. The lid 28 is then held in the opened position and prevented from moving to the closed position as long as the locking element 172 bears against the hinge frame 98.

Thus, when the hanging bar 100 is moved to the use position, the corresponding or resulting movements of the hanging bar 100, the biasing assembly 150, and the locking assembly 170 serve to automatically bias the locking assembly 170 to the locked position when the hanging bar 100 occupies the use position for an improved user experience. The automatic movement of the locking assembly 170 to the locked position to retain the lid 28 in the opened position when the hanging bar 100 is in the use position simplifies use of the hanging bar 100 for the user such that the user need not hold the lid 28 open with one hand while trying to hang the laundry item on the hanging bar 100. Instead, the automatic biasing of the locking assembly 170 allows for the user to have both hands free for hanging the laundry items on the hanging bar 100.

The operation of the hanging bar 100 is further automated in that the releasing of the retaining element 120 by the user, which can be done with one hand, or even with only a single finger, causes the hanging bar 100 to be automatically biased to the use position, as well as the automatic biasing of the locking assembly 170. This further improves the user experience such that the user does not have to go to the effort of manually moving the hanging bar 100 to the use position, which may require the use of both hands or user interaction with multiple actuatable features or structures. However, it will be understood that, in one example, while the retaining element 120 is illustrated herein as being biased toward the retaining position such that a user can easily deflect the retaining element 120 to allow automatic release of the hanging bar 100, the retaining element 120 can be any suitable retaining element 120, non-limiting examples of which include actuatable retaining elements that are not biased and thus require further mechanical actuation by the user, retaining elements that are not actuatable, latches, hooks, or clasps, including stationary latches, hooks, or clasps, or electrically actuatable retaining elements.

It will be further understood that, while the hanging bar 100 is illustrated herein as being automatically biased toward the use position, it is within the scope of the present disclosure that the hanging bar 100 could not be biased toward the use position, such that the user would manually move the hanging bar 100 from the storage position into the use position. In this case, the other aspects of the disclosure can still apply, such as the soft open damper 160 or the automatic biasing of the locking assembly 170 to the locked position to hold the lid 28 in the opened position when the hanging bar 100 is in the use position, and can still provide for an improved user experience regardless of whether or not the hanging bar 100 is initially biased toward the use position.

Due to the automatic biasing of the locking assembly 170 to the locked position, the lid 28 remains held in the opened position and prevented from moving to the closed position as long as the hanging bar 100 remains in the use position, ensuring that the lid 28 will not be inadvertently moved to the closed position when the hanging bar 100 is in use. The locked position of the locking assembly 170 further serves to ensure that the hanging bar 100 in the use position is maintained in an appropriate position relative to the treating chamber 32 and the access opening 15 such that liquid or soil that collects from or drips off of laundry items hanging on the hanging bar 100 is collected within the treating chamber 32, avoiding potential messes in a household laundry area.

When the user no longer intends to use the hanging bar 100 or desires to close the lid 28, the user can grasp, lift, or push the hanging bar 100 from the use position into the storage position. The retaining element 120 can be shaped and positioned such that is automatically deflected away from the retaining position when the hanging bar 100 is pushed against or bears against the retaining element 120 to return to the storage position, and then is automatically biased by the biasing element 130 to return to the retaining position once the hanging bar 100 has moved past the retaining element 120 and into the storage position and no longer deflects the retaining element 120 away from the retaining position, allowing the hanging bar 100 to snap into place to be retained by the retaining element 120 in the storage position. Movement of the hanging bar 100 from the use position into the storage position by the user will automatically move the biasing assembly 150 to the storage configuration and the locking assembly 170 to the unlocked position, disengaging the locking flange 174 from the engaging surface 176, and allowing the lid 28 to once again be freely moved between the opened and closed positions.

Figure 13:
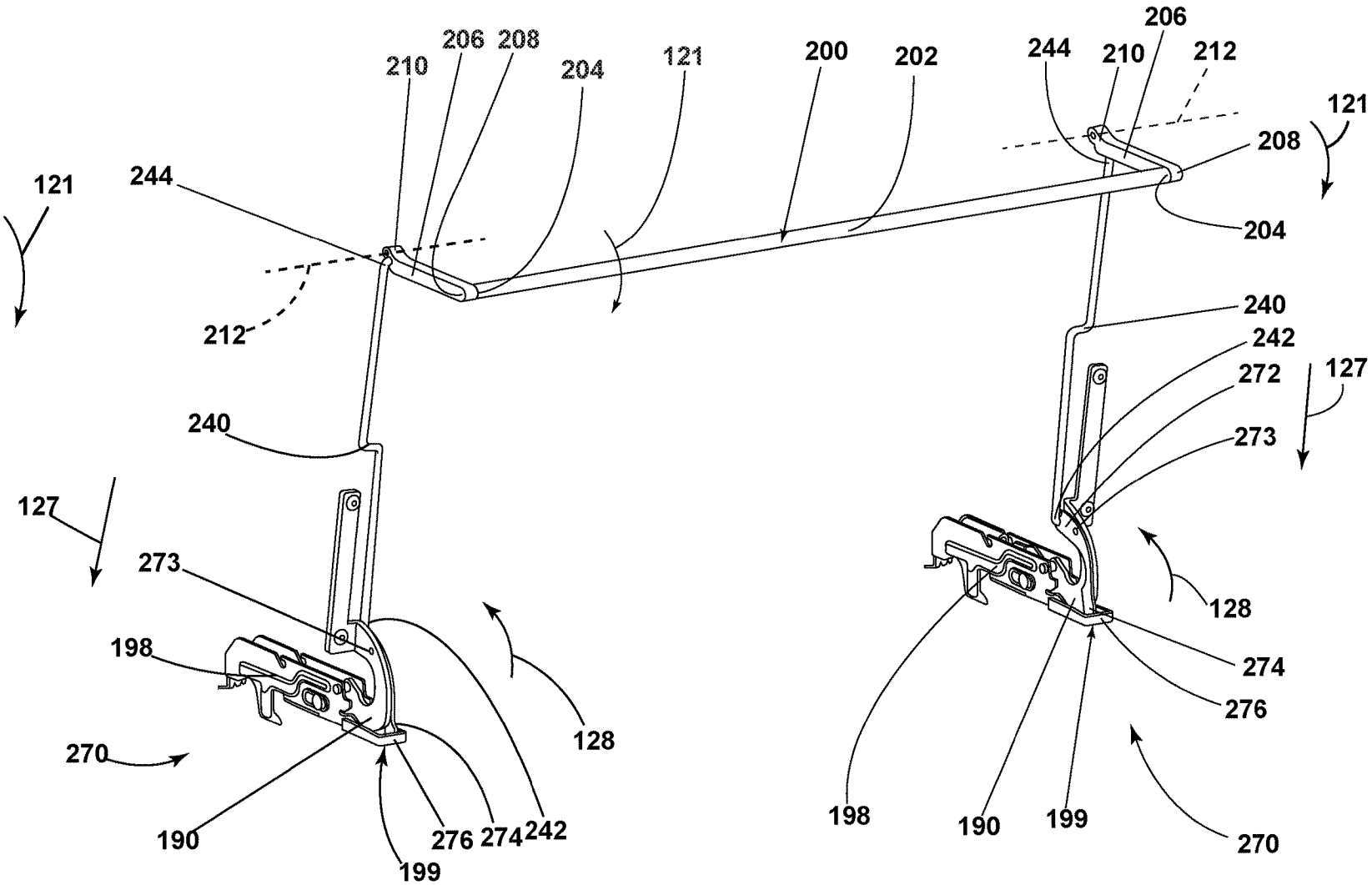
FIG. 13 is a perspective view of another example of a hanging bar and a locking assembly that can be provided with the cover of FIG. 3, shown with the cover removed and the hanging bar in the use position.

Turning now to FIG. 13, another example of a hanging bar 200, a pair of linking elements 240, and a pair of locking assemblies 270 for use with the lid 28 is shown. The hanging bar 200, linking elements 240, and locking assemblies 270 are similar to the hanging bar 100, linking elements 140, and locking assemblies 170, and share many of the same features and components as the hanging bar 100, linking elements 140, and locking assemblies 170, but differ in some aspects, such as the structural details and configurations of the hanging bar 200, linking elements 240, and locking assemblies 270. Therefore, elements of the hanging bar 200, linking elements 240, and locking assemblies 270 that are similar to those of the hanging bar 100, linking elements 140, and locking assemblies 170 are identified with numerals increased by 100, with it being understood that the description of the like parts of the hanging bar 100, linking elements 140, and locking assemblies 170 applies to the hanging bar 200, linking elements 240, and locking assemblies 270, unless otherwise noted.

The hanging bar 200 is similar to the hanging bar 100 in that the hanging bar 200 comprises a rod 202 having opposing ends 204 with a leg 206 extending from each of the opposing ends 204. The legs 206 can each be movably coupled, such as rotatably coupled, with a second end 244 of each of the linking elements 240. The hanging bar 200 differs from the hanging bar 100 in that a separate coupling element 108 is not included. Rather, the legs 206 themselves include, define, and act as coupling elements 208 and coupling ends 210. Specifically, each of the legs 206 define a coupling element 208 where each of the legs 206 couple with each of the opposing ends 204, and further define each of the coupling ends 210 that are directly operably coupled with the second ends 244 of each of the linking elements 240. The hanging bar 200 is rotatably movable from a storage position to a use position, as shown, relative to the linking element 240 and in the direction of the arrow 121.

The linking elements 240 are not identical in structure to the linking element 140, but do similarly each include a first end 242 and the second end 244, illustrated herein as opposing ends 242, 244. The linking elements 240 are each further operably coupled with the hanging bar 200 at the second ends 244 and with each of the locking assemblies 270, and specifically with each locking element 272, at the first ends 242. When the lid 28 is in the opened position, corresponding to the position of the hinge assemblies 190 as shown, the hanging bar 200 can be freely moved between the storage position and the use position. The linking elements 240 are configured for translational movement relative to the hanging bar 200 and to the locking assemblies 270 from a storage configuration to a use configuration in the direction of the arrow 127.

The locking assemblies 270 operably couple with the first ends 242 of the linking elements 240, and are thus further operably coupled with the hanging bar 200 via the linking elements 240. The first ends 242 are further movably coupled relative to each of the hinge assemblies 190 via the direct operable coupling of each of the first ends 242 with each of the locking elements 272. Specifically, each of the locking elements 272 are in turn movably coupled relative to each of the hinge assemblies 190, such that each of the locking elements 272 are rotatable relative to each of the hinge assemblies 190 and each about a coupler 273, each illustrated herein, by way of non-limiting example, as a coupling pin 273, between the locked and unlocked positions. The locking assemblies 270 each comprise a hinge frame 198, the hinge assembly 190, the locking element 272 having a locking flange 274, and a hinge frame extension 199 having an engaging surface 276. The locking assemblies 270 are similar to the locking assemblies 170, but differ in the direction of movement of the locking elements 272, the location of the engaging surfaces 276, and the inclusion of the hinge frame extensions 199. In one example, each of the hinge assemblies 190 can be thought of as comprising the hinge frame 198 and the hinge frame extension 199.

The locking assemblies 270 are operably coupled with the linking elements 240, and, in turn, with the hanging bar 200, for movement between an unlocked position (FIG. 14) and a locked position (FIG. 15), such as for rotational movement from the unlocked position to the locked position about the first ends 242 and about the coupling pins 273, and in the direction of the arrow 128. Specifically, the locking assemblies 270 can be configured for rotational movement relative to the linking elements 240, the first ends 242, and the coupling pins 273, from the unlocked position to the locked position in response to the translational movement of the linking elements 240 as the hanging bar 200 moves between the storage position and the use position. Further, and as illustrated, rotational movement of the hanging bar 200 from the storage position to the use position in the direction of the arrow 121 effects translational movement of each of the linking elements 240 downwardly in the direction of the arrow 127 and from the storage configuration to the use configuration, which in turn effects rotational movement of the locking assemblies 270 in the direction of the arrow 128 and from the unlocked position to the locked position.

Figure 14:
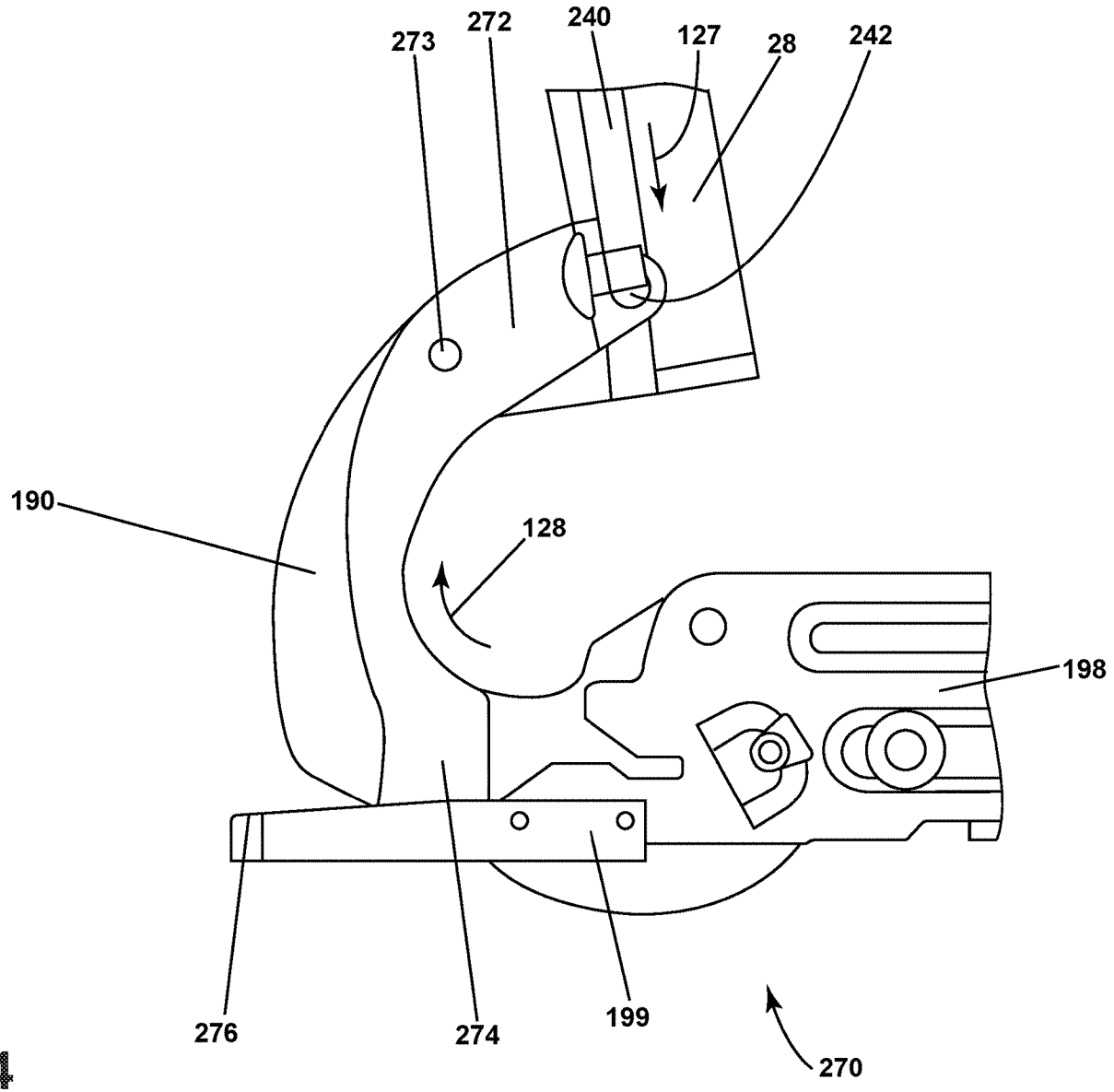
FIG. 14 is an enlarged side view of a portion of the locking assembly of FIG. 13 and including another example of a locking element shown in an unlocked position and with the cover in the opened position.

Turning now to FIG. 14, an enlarged view of one of the locking assemblies 270 is shown in the unlocked position, corresponding to the hanging bar 200 in the storage position, and with the lid 28 in the opened position relative to the hinge frame 198. The locking element 272 defines the locking flange 274 that extends downwardly from the body of the locking element 272 and in plane with the locking element 272, and in particular extends away from the lid 28, the linking element 240, the first end 242, and the coupling pin 273. The hinge frame extension 199 is coupled to the hinge frame 198, such as fixedly coupled, and extends forwardly from the hinge frame 198, and substantially parallel to the lid 28 in the closed position, so as to extend beyond at least a portion of the hinge assembly 190 and of the locking element 272. Specifically, when the locking assembly 270 and the locking element 272 are in the unlocked position, the hinge frame extension 199 extends beyond the locking element 272 and the hinge assembly 190, which are coupled by the coupling pin 273, such that the coupled locking element 272 and hinge assembly 190 do not abut or overlie the engaging surface 276 defined by the hinge frame extension 199. The engaging surface 276 can be positioned and configured to selectively engage with the locking flange 274.

The unlocked position of the locking assembly 270, as shown, can be defined by the position of the locking element 272 relative to the hinge frame extension 199, and more specifically by the position of the locking flange 274 relative to the engaging surface 276. In the unlocked position, the locking element 272, particularly the locking flange 274, is spaced from the hinge frame extension 199, particularly the engaging surface 276, such that the locking flange 274 does not abut the engaging surface 276. When the hanging bar 200 is in the storage position, regardless of whether the lid 28 occupies the closed or the opened position, the locking assembly 270 and the locking element 272 are in the unlocked position such that the hinge assembly 190 can move freely relative to the hinge frame 198 and the hinge frame extension 199 for movement of the lid 28 between the opened and closed positions.

Figure 15:
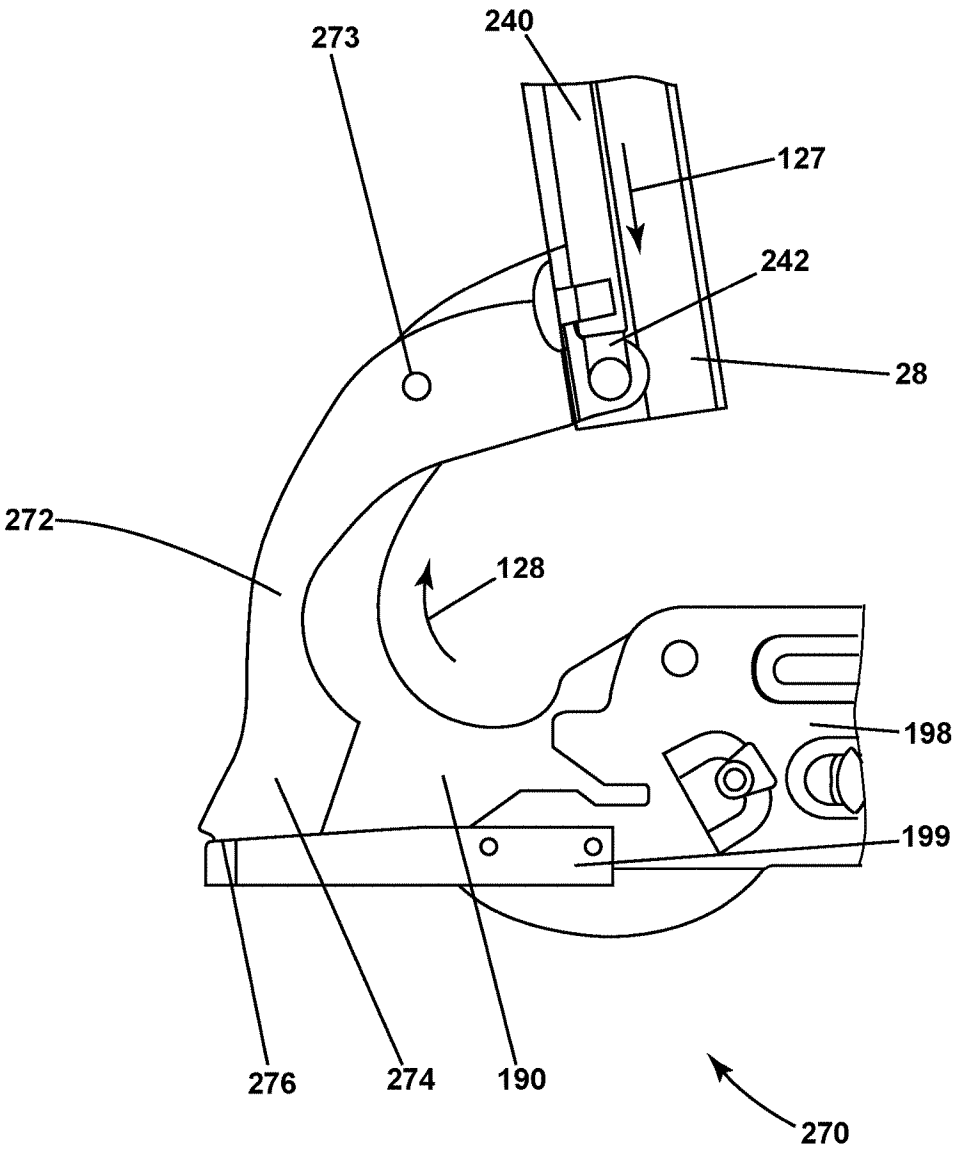
FIG. 15 is a side view of the locking element of FIG. 14, shown with the locking element in a locked position and the cover in the opened position.

Referring now to FIG. 15, the one of the locking assemblies 270 is shown in the locked position, corresponding to the hanging bar 200 in the use position, and with the lid 28 in the opened position relative to the hinge frame 198. The locked position of the locking assembly 270, like the unlocked position, can be defined by the position of the locking element 272 relative to the hinge frame extension 199, and more specifically by the position of the locking flange 274 relative to the engaging surface 276. In the locked position, the locking element 272, and in particular the locking flange 274, is in contact with the hinge frame extension 199, particularly to abut and to bear against the engaging surface 276. In one example, in the locked position, the locking flange 274 bears against the engaging surface 276 such that the locking flange 274 at least partially overlies and rests on top of at least a portion of the engaging surface 276. When the locking flange 274 overlies and rests on the engaging surface 276, the weight of the lid 28 causes the locking flange 274 to bear against the engaging surface 276 due to gravity.

When the lid 28 is in the opened position and the hanging bar 200 is in the use position, the locking assembly 270 and the locking element 272 occupy the locked position such that the locking element 272 bears against the hinge frame extension 199 and prevents movement of the hinge assembly 190, due to the coupling of the locking element 272 and the hinge assembly 190 by the coupling pin 273, relative to the hinge frame 198 and to the hinge frame extension 199 in the direction opposite of the arrow 128, in turn preventing the lid 28 from moving from the opened position to the closed position. Thus, the lid 28 is prevented from moving to the closed position when the hanging bar 200 is in the use position, corresponding to the locked position of the locking assembly 270 and the locking element 272. In this way, the bearing of the locking flange 274 against the engaging surface 276 holds the lid 28 in the opened position and prevents movement of the lid 28 to the closed position until the locking element 272 is removed from contact with the hinge frame extension 199, corresponding to the hanging bar 200 occupying the storage position.

Turning now to the operation of the hanging bar 200, one of the linking elements 240, and one of the locking assemblies 270, it will be understood that the disclosure of the hanging bar 100, the linking elements 140, and the locking assemblies 170 can apply herein, such that the lid 28 comprising the hanging bar 200, the linking elements 240, and the locking assemblies 270 can also include other features not shown, such as the retaining element 120, the biasing assemblies 150, or the dampers 160. The hanging bar 200 may or may not be biased to either the storage position or the use position, the hanging bar 200 may or may not be retained in either the storage position or the use position, the lid 28 may or may not include the dampers 160, and the lid 28 may or may not require the user to physically move the hanging bar 200 between the storage and the use positions. Regardless of what other such features or structures are optionally included, when the hanging bar 200 is in the storage position, the linking elements 240 occupy the storage configuration, and the locking elements 270 occupy the unlocked position, whereas when the hanging bar 200 is in the use position, the linking elements 240 occupy the use configuration, and the locking elements 270 occupy the locked position.

When a user decides to use the hanging bar 200, the hanging bar 200 is moved from the storage position to the use position, such as by actuation, by biasing force, or by movement of the hanging bar 200 by the user. Specifically, the hanging bar 200 is rotated from the storage position to the use position relative to the lid 28 and to the linking element 240 in the direction indicated by the arrow 121 and about an axis of rotation 212 defined by the coupling end 210. Because the second end 244 is further operably coupled with the coupling end 210 of the hanging bar 200, the rotational movement of the hanging bar 200 toward the use position and about the coupling end 210 in turn correspondingly moves at least a portion of the coupling end 210 in the same direction of the arrow 121 to effect further corresponding movement of the coupling end 210 and therefore also of the linking element 240 relative to the hanging bar 200. In one example, the rotational movement of the hanging bar 200 and of the at least a portion of the coupling end 210 in the direction of the arrow 121 effects a corresponding translational movement of the linking element 240, and specifically of the second end 244, by deflecting the linking element 240 downwardly and away from the hanging bar 200, and from the storage configuration to the use configuration, in the direction of the arrow 127 in response to the rotational movement of the hanging bar 200 into the use position.

In this way, the biasing or the movement of the hanging bar 200 toward the use position, and the resulting rotational movement of the hanging bar 200 downwardly and away from the lid 28 and into the use position, causes a corresponding biasing, which can be thought of as an opposing biasing or a counter-biasing, of the linking element 240 from the storage configuration to the use configuration, and the resulting translational movement of the linking element 240 downwardly and away from the hanging bar 200 in the direction of the arrow 127, toward the use configuration.

The translational movement of the linking element 240 downwardly and away from the hanging bar 200 is further operably coupled with the locking assembly 270. Because the first end 242 is operably coupled with the locking element 272 of the locking assembly 270, and further because the locking element 272 is rotatably coupled with the hinge assembly 190 by the coupling pin 273, the translational movement of the linking element 240 downwardly and away from the hanging bar 200 and toward the locking assembly 270 in the direction of the arrow 127 in turn correspondingly moves at least a portion of the locking element 272 in the same direction of the arrow 127 to effect further corresponding movement of the locking element 272 and the locking assembly 270 relative to the linking element 240 and to the coupling pin 273. In one example, the translational movement of the linking element 240 and of the at least a portion of the locking element 272 in the direction of the arrow 127 effects a corresponding rotational movement of the locking element 272 about the coupling pin 273, and further specifically of at least a portion of the locking element 272 that includes the locking flange 274, about the first end 242 and about the coupling pin 273, and from the unlocked position (FIG. 14) to the locked position (FIG. 15), in the direction of the arrow 128 in response to the translational movement of the linking element 240 into the use configuration.

In this way, the biasing of the linking element 240 from the storage configuration to the use configuration, and the resulting translational movement of the linking element 240 downwardly and away from the hanging bar 200 and toward the locking assembly 270 in the direction of the arrow 127, toward the use configuration, causes a corresponding biasing, which can be thought of as an opposing biasing or a counter-biasing, of the locking assembly 270 from the unlocked position to the locked position, and the resulting rotational movement of the locking element 272 and the locking flange 274 about or relative to axes of rotation defined by the first end 242 and by the coupling pin 273, forwardly and upwardly toward the inner surface 82 in the direction of the arrow 128, toward the locked position.

In further detail, prior to the movement of the hanging bar 200 to the use position and the linking element 240 to the use configuration, the locking assembly 270 is retained in the unlocked position of FIG. 14, such that the locking element 272 is spaced from and does not abut the hinge frame extension 199, and more specifically such that the locking flange 274 is spaced from and does not abut the engaging surface 276, allowing the hinge assembly 190 to move freely relative to the hinge frame 198 and the lid 28 to move freely between the closed and opened positions, in turn.

When the hanging bar 200 is moved or biased into the use position, the translational movement of the linking element 240 downwardly and away from the hanging bar 200 and in the direction of the arrow 127, in a direction toward the locking assembly 270, correspondingly pushes the portion of the locking element 272 that couples to the first end 242 in the same direction of the arrow 127 and downwardly and toward the hinge frame 198. The travel of the at least a portion of the locking element 272 in the direction of the arrow 127, downwardly and away from the hanging bar 200, and toward the hinge frame 198, is limited by the coupling of the locking element 272 to the coupling pin 273, and further to the hinge assembly 190 via the coupling pin 273. The locking element 272 is prevented from moving vertically relative to the coupling pin 273, such that the pushing of the portion of the locking element 272 that couples with the first end 242 downwardly and in the direction of the arrow 127 causes rotational movement of the locking element 272 from the unlocked position to the locked position in the direction of the arrow 128. Specifically, the locking element 272 is caused to rotate about the coupling pin 273, as well as relative to the first end 242, as the coupling of the locking element 272 and the first end 242 is pushed downwardly and away from the hanging bar 200 and toward the hinge frame 198. In this way, the portion of the locking element 272 that carries the locking flange 274 is correspondingly caused to rotate forwardly and upwardly until the locking flange 274 abuts and bears against the engaging surface 276 in the locked position and further rotational movement of the locking element 272 is prevented. The lid 28 is then held in the opened position and prevented from moving to the closed position as long as the locking element 272 bears against the hinge frame extension 199.

When the user no longer intends to use the hanging bar 200 or desires to close the lid 28, the user can grasp, lift, or push the hanging bar 200 from the use position into the storage position. Movement of the hanging bar 200 from the use position into the storage position by the user will automatically move the linking element 240 to the storage configuration and the locking assembly 270 to the unlocked position, disengaging the locking flange 274 from the engaging surface 276, and allowing the lid 28 to once again be freely moved between the opened and closed positions.

Figure 16:
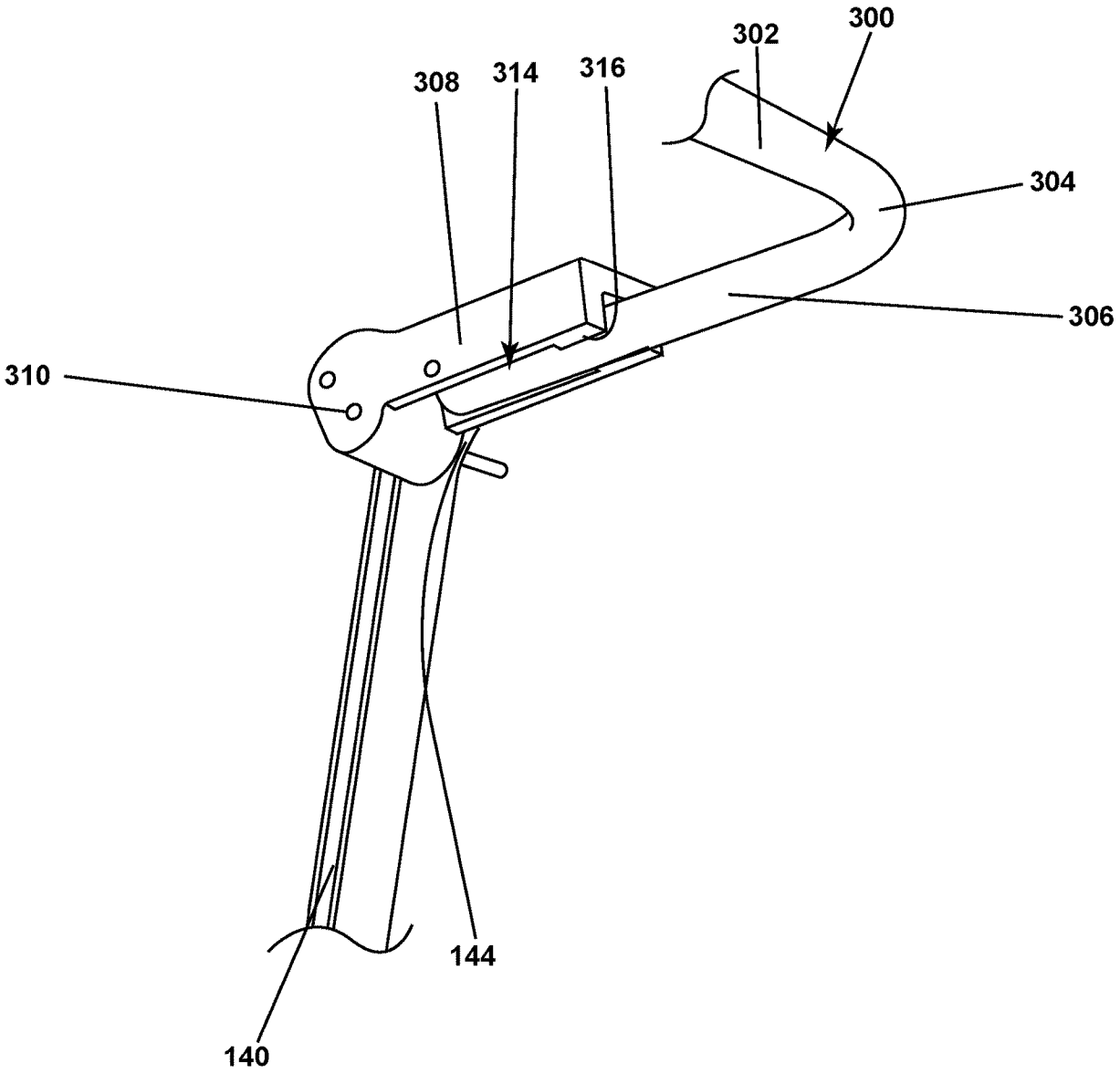
FIG. 16 is an enlarged perspective view of a portion of another example of a hanging bar that can be provided with the cover of FIG. 3, with the hanging bar in the use position.

Turning now to FIG. 16, another example of a hanging bar 300 for use with the lid 28 is shown in the use position relative to the linking element 140. The hanging bar 300 is similar to the hanging bar 100 and shares many of the same features and components as the hanging bar 100, but differs in some aspects, such as the structure of coupling elements 308. Therefore, elements of the hanging bar 300 that are similar to those of the hanging bar 100 are identified with numerals increased by 200, with it being understood that the description of the like parts of the hanging bar 100 applies to the hanging bar 300, unless otherwise noted.

The hanging bar 300 comprises a rod 302 having opposing ends 304 with a leg 306 extending from each of the opposing ends 304. The legs 306 can be rotatably coupled to the lid 28, and specifically can each be rotatably coupled to the second end 144 of each linking element 140, as with the hanging bar 100. The hanging bar 300 differs from the hanging bar 100 in the structure of the coupling elements 308. While the coupling elements 308 each at least partially receive each of the legs 306 and each include a coupling end 310, similar to the coupling elements 108, the coupling elements 308 each further comprise a breakaway portion 314.

In one example, as illustrated herein, each breakaway portion 314 can be provided as an opening or an open face defined by each coupling element 308 and extending along a portion of each leg 306. Further, each of the legs 306 can be thought of as comprising or collectively forming at least a portion of each of the breakaway portions 314. In a further example, each of the breakaway portions 314 are positioned such that each of the breakaway portions 314 are provided along and confronting a lower surface of the hanging bar 300 when the hanging bar 300 is in the use position. Each coupling element 308 can further comprise at least one retaining flange 316, which can be at least partially defined by or coupled with each breakaway portion 314. The retaining flanges 316 are configured to retain the hanging bar 300 within each of the coupling elements 308, as well as optionally within each of the breakaway portions 314, such as by an interference fit or a snap fit of each leg 306 within each coupling element 308 and/or within the retaining flanges 316.

Figure 17:
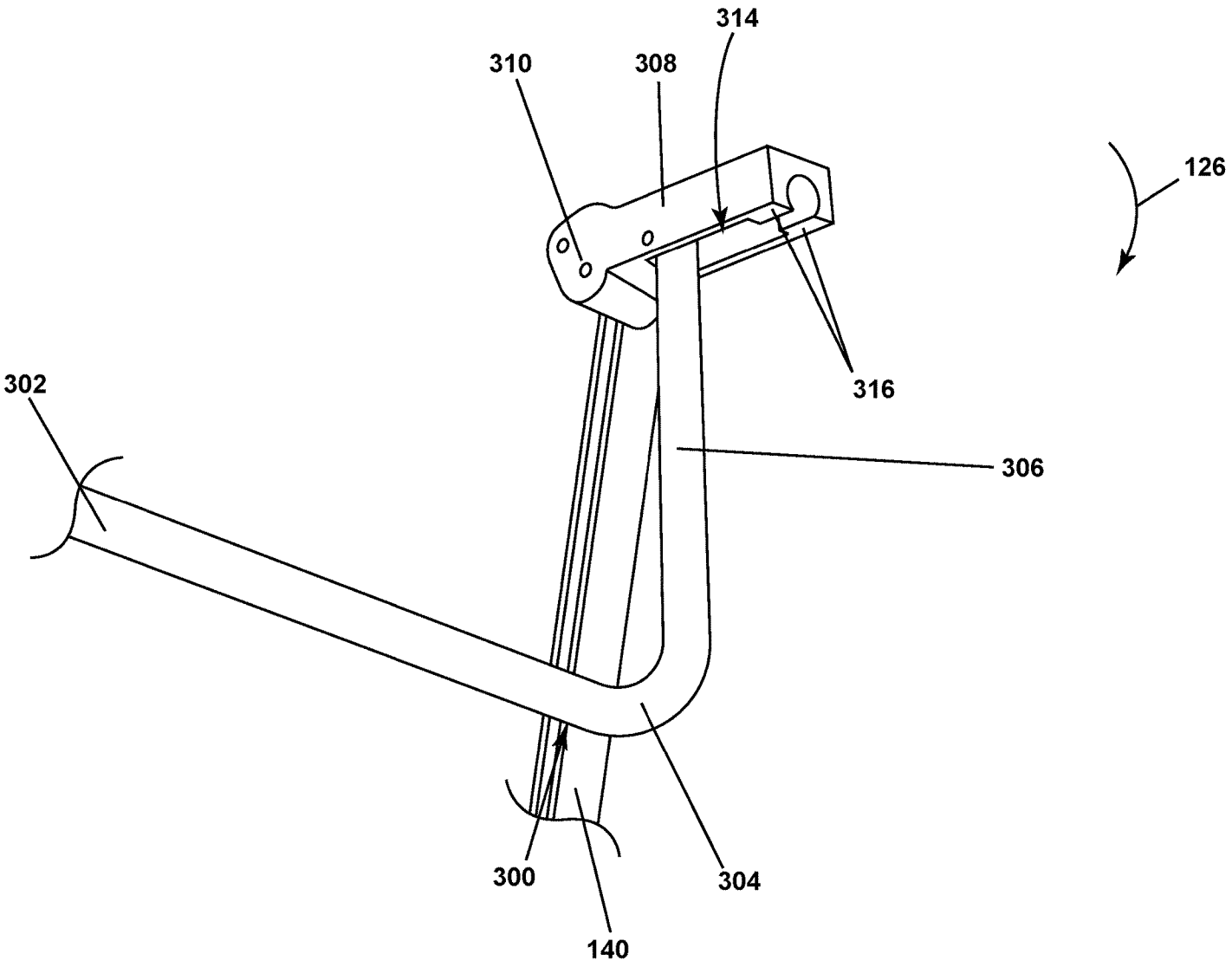
FIG. 17 is a perspective view of the portion of the hanging bar of FIG. 16, with the hanging bar in a breakaway position.

Turning now to FIG. 17, the hanging bar 300 is shown in a breakaway position. In the breakaway position, the hanging bar 300 has at least partially broken away from at least one of the breakaway portions 314, the retaining flanges 316, and the coupling elements 308. When the hanging bar 300 moves to the breakaway position, the hanging bar 300 is rotated downwardly, passing through at least one of the breakaway portions 314 relative to the coupling element 308, and in the direction of the arrow 126.

Referring to the operation of the hanging bar 300, the hanging bar 300 comprising the breakaway portions 314 is configured such that, if too much weight is provided to the hanging bar 300, rather than breaking or damaging the hanging bar 300, the hanging bar 300 and the breakaway portions 314 are configured to allow the hanging bar 300 to collapse into the breakaway position if too much weight is provided to the hanging bar 300. In one example, each leg 306 is retained within each coupling element 308 by an interference fit with the at least one retaining flange 316. If laundry items with too much weight are provided on the hanging bar 300 and the weight of the laundry items exceeds the strength of the interference fit between the at least one retaining flange 316 and the hanging bar 300, the heavy laundry items will cause the gravitational force applied to the hanging bar 300 to overcome the interference fit and to cause the hanging bar 300 to snap through or past or to outwardly deflect the at least one retaining flange 316 to allow the hanging bar 300 to move downwardly to at least partially pass through at least one of the breakaway portions 314 and into the breakaway position in the direction of the arrow 126. The hanging bar 300 can be partially retained by at least one of the coupling elements 308 in the breakaway position, or the hanging bar 300 can detach completely from at least one of the coupling elements 308 in the breakaway position. In this way, if the hanging bar 300 is overloaded, damage to the hanging bar 300 or related components can be avoided by providing the breakaway portions 314 to allow the hanging bar 300 to detach from the lid 28 when sufficient force or weight is applied to the hanging bar 300.

Figure 18:
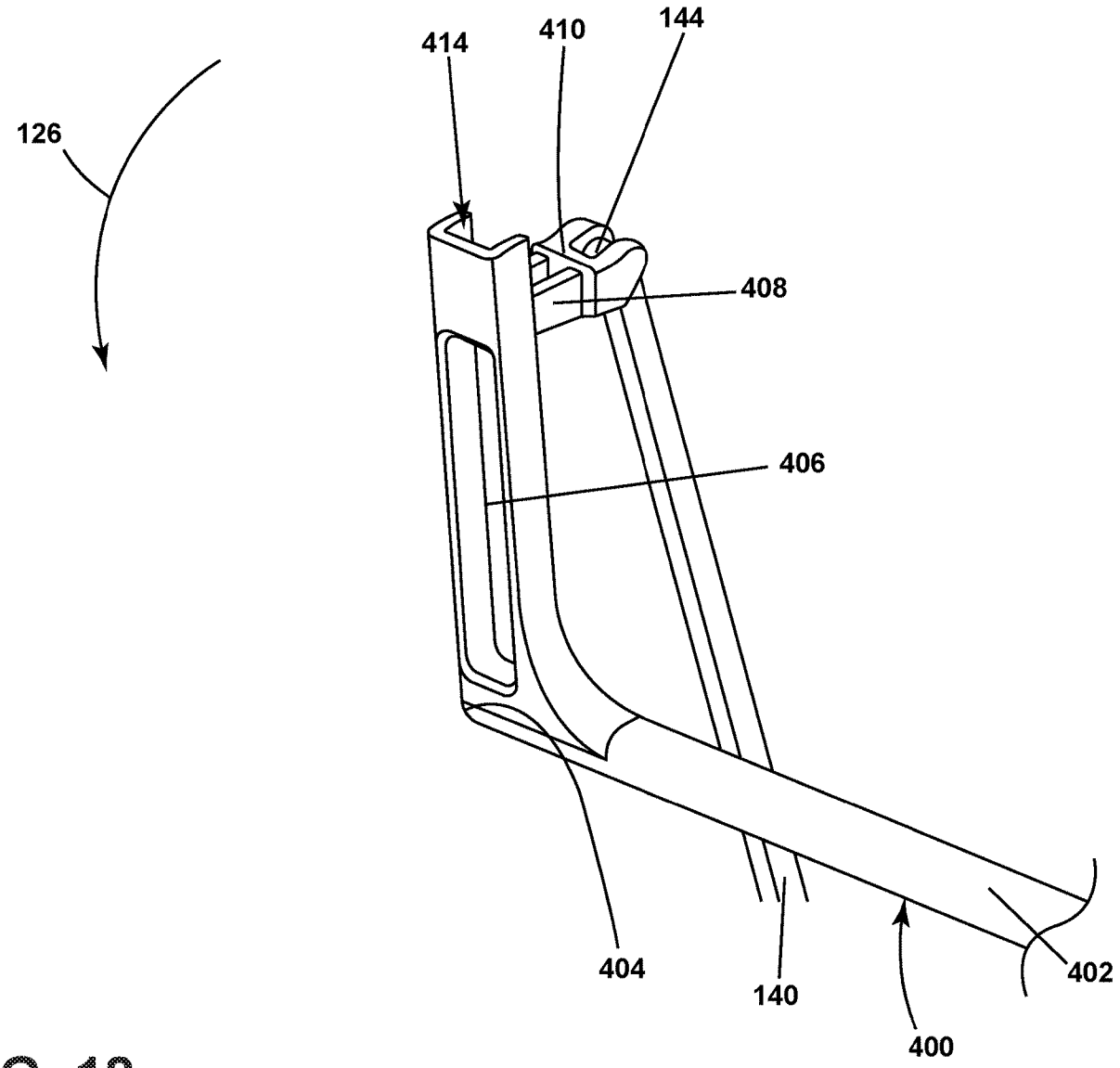
FIG. 18 is a perspective view of a portion of another example of a hanging bar that can be provided with the cover of FIG. 3, with the hanging bar in a breakaway position.

Turning now to FIG. 18, another example of a hanging bar 400 for use with the lid 28 is shown in a breakaway position relative to the linking element 140. The hanging bar 400 is similar to the hanging bar 300 and shares many of the same features and components as the hanging bar 300, but differs in some aspects, such as the structure of each coupling element 408 and of each breakaway portion 414. Therefore, elements of the hanging bar 400 that are similar to those of the hanging bar 300 are identified with numerals increased by 100, with it being understood that the description of the like parts of the hanging bar 300 applies to the hanging bar 400, unless otherwise noted.

The hanging bar 400 comprises a rod 402 having opposing ends 404 with a leg 406 extending from each of the opposing ends 404. The legs 406 can be rotatably coupled to the lid 28, and specifically can each be rotatably coupled to the second end 144 of each linking element 140, as with the hanging bar 300. The hanging bar 400 differs from the hanging bar 300 in the structure of each of the coupling elements 408 and of each of the breakaway portions 414. Similar to the coupling elements 308, the coupling elements 408 each include a coupling end 410 that couples to the second end 144 of each linking element 140. However, the coupling element 408 differs from the coupling element 308 in that, rather than each of the legs 306 being at least partially received within each of the coupling elements 308 as in the hanging bar 300, in the case of the hanging bar 400, each of the legs 406 comprises each breakaway portion 414, and further at least partially defines each breakaway portion 414. Further, each coupling element 408 is at least partially received within each leg 406, and specifically within the breakaway portion 414 of each leg 406.

In one example, as illustrated herein, each breakaway portion 414 can be provided as an opening or an open face defined by each leg 406 and extending along a portion of each leg 406 and along at least a portion of each coupling element 408 that is received within each leg 406, and is further received within each breakaway portion 414. Further, each coupling element 408 can be thought of as comprising or collectively forming at least a portion of each breakaway portion 414. In a further example, each breakaway portion 414 is positioned such that each breakaway portion 414 is provided along and confronting a lower surface of each coupling element 408 when the hanging bar 400 and each coupling element 408 are in the use position. Each breakaway portion 414 can further comprise at least one retaining flange (not shown), such as in the case of the at least one retaining flange 316 of the hanging bar 300, which can be at least partially defined by or coupled with at least one of the coupling elements 408 or the legs 406 to retain each coupling element 408 within each breakaway portion 414 of each leg 406, such as by an interference fit or a snap fit of each coupling element 408 within each leg 406, and further within each breakaway portion 414.

The hanging bar 400 is shown in the breakaway position wherein the hanging bar 400 has at least partially broken away from at least one of the coupling elements 408 along at least one of the breakaway portions 414. When the hanging bar 400 moves to the breakaway position as shown, the hanging bar 400 is rotated downwardly relative to at least one of the coupling elements 408, such that the at least one of the coupling elements 408 at least partially moves through at least one of the breakaway portions 414, and in the direction of the arrow 126.

Referring to the operation of the hanging bar 400, the hanging bar 400 comprising the breakaway portions 414 is configured such that, if too much weight is provided to the hanging bar 400, rather than breaking or damaging the hanging bar 400, the hanging bar 400 and the breakaway portions 414 are configured to allow the hanging bar 400 to collapse into the breakaway position if too much weight is provided to the hanging bar 400. In one example, each coupling element 408 is retained within each leg 406 by an interference fit or a snap fit. If laundry items with too much weight are provided on the hanging bar 400 and the weight of the laundry items exceeds the strength of the interference fit between at least one of the coupling elements 408 and the hanging bar 400, the heavy laundry items will cause the gravitational force applied to the hanging bar 400 to overcome the force of the interference fit retaining at least one of the coupling elements 408 within at least one of the breakaway portions 414 of at least one of the legs 406. In the case that the weight of the laundry items overcomes the force of the interference fit between at least one of the coupling elements 408 and at least one of the breakaway portions 414, the at least one of the coupling elements 408 is caused to snap through or past or to outwardly deflect the at least one of the breakaway portions 414 of at least one of the legs 406. This allows the hanging bar 400 to move downwardly, such that at least one of the coupling elements 408 at least partially passes through at least one of the breakaway portions 414, and into the breakaway position in the direction of the arrow 126. The hanging bar 400 can be partially retained such that it remains at least partially coupled to at least one of the coupling elements 408 in the breakaway position, or the hanging bar 400 can detach completely from at least one of the coupling elements 408 in the breakaway position. In this way, if the hanging bar 400 is overloaded, damage to the hanging bar 400 or related components can be avoided by providing the breakaway portions 414 to allow the hanging bar 400 to at least partially detach from the lid 28 when sufficient force or weight is applied to the hanging bar 400.

Figure 19:
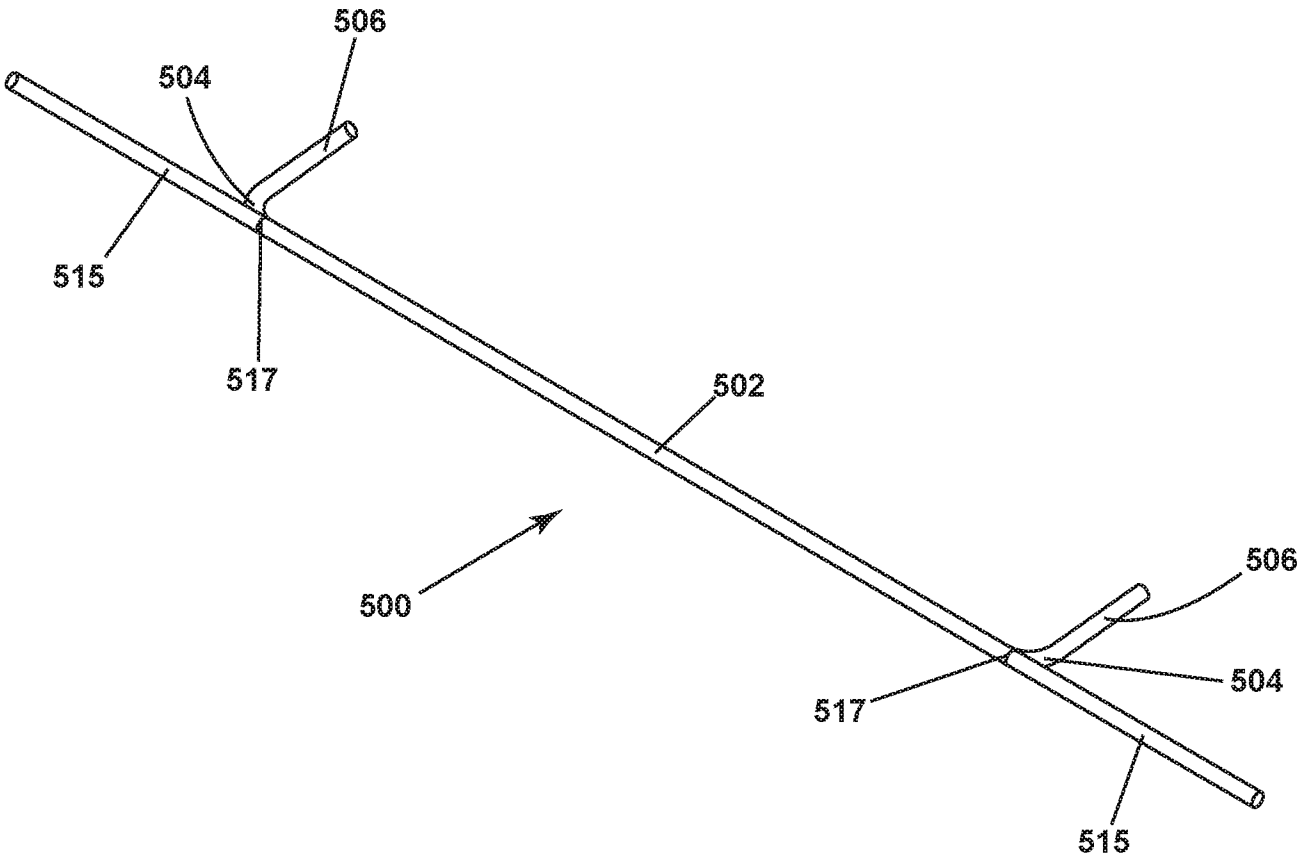
FIG. 19 is a perspective view of another example of a hanging bar that can be provided with the cover of FIG. 3, with the hanging bar in the use position.

Referring now to FIG. 19, another example of a hanging bar 500 for use with the lid 28 is shown in a use position. The hanging bar 500 is similar to the hanging bar 100 and shares many of the same features and components as the hanging bar 100, but differs in some aspects, such as the inclusion of at least one extendable portion 515. Therefore, elements of the hanging bar 500 that are similar to those of the hanging bar 100 are identified with numerals increased by 400, with it being understood that the description of the like parts of the hanging bar 100 applies to the hanging bar 500, unless otherwise noted.

The hanging bar 500 comprises a rod 502 having opposing ends 504 with a leg 506 extending from each of the opposing ends 504. The legs 506 can be movably coupled, such as rotatably coupled, relative to the lid 28 for movement of the hanging bar 500 between the storage position and the use position, and specifically can each be rotatably coupled to the second end 144 of a different one of the linking elements 140, as with the hanging bar 100. By way of non-limiting example, each of the legs 506 can be movably coupled directly to the second end 144 of the different one of the linking elements 140, or one coupling element 108 can be provided between each leg 506 and the lid 28 to at least partially receive and to movably couple each leg 506 relative to the lid 28, as in the case of the hanging bar 100. While each leg 506 is described herein as optionally coupled to the lid 28 via one of the coupling elements 108, it will be understood that each leg 506 can instead be coupled directly to the second end 144 of one of the linking elements 140, with no coupling element 108 provided, or, alternatively, that any of the other suitable coupling elements 108, 208, 308, 408 as described herein can be provided and need not be limited to the coupling elements 108 provided with the hanging bar 100.

The hanging bar 500 differs from the hanging bar 100 in that the hanging bar 500 comprises at least one extendable portion 515. As illustrated herein, the hanging bar 500 can be provided with a pair of extendable portions 515, which can be thought of as opposing extendable portions 515 such that each of the extendable portions 515 extends from a different one of the opposing ends 504. In one example, the rod 502 at least partially defines a pair of open ends 517 provided at or adjacent to the opposing ends 504. Each open end 517 can at least partially receive one of the extendable portions 515 for movement relative to the open end 517.

In further detail and by way of non-limiting example, each of the extendable portions 515 is received by one of the open ends 517 of the rod 502 such that each extendable portion 515 is telescopingly received within the hanging bar 500, such as within the rod 502, for sliding or telescoping movement relative to the hanging bar 500. Specifically, each extendable portion 515 is received by a different one of the open ends 517 for selective insertion or withdrawal of each extendable portion 515 relative to the hanging bar 500, and in particular relative to the rod 502, for movement of each extendable portion 515 between an extended position, as shown, and an inserted position (not shown).

In the inserted position (not shown), each extendable portion 515 can be inserted through the different one of the open ends 517 and into an interior of the hanging bar 500, and, more specifically, into the rod 502, to reach the fully inserted position. In the fully inserted position, each extendable portion 515 is inserted within the hanging bar 500 to the point that extendable portion 515 is prevented from being further inserted into the hanging bar 500 and is at least partially received within the hanging bar 500. In one example, each extendable portion 515 can be nearly completely received within the hanging bar 500 in the inserted position. By further way of non-limiting example, the extendable portions 515 are inserted into the rod 502 through opposing open ends 517 and are inserted toward one another, inwardly from the legs 506 and the opposing ends 504, toward a center or a midpoint of the hanging bar 500, or more specifically of the rod 102.

The size and configuration of the extendable portions 515 and the rod 502 of the hanging bar 500 can be specifically selected such that the length of the extendable portions 515 is maximized. In one example, the extendable portions 515 in the fully inserted position can collectively extend within and across the entire length of the rod 502 and can contact or abut one another within the hanging bar 500 in the inserted position. In the inserted position, the extendable portions 515 may not extend or protrude outwardly from the hanging bar 500 at all, or, by way of non-limiting example, the extendable portions 515 may extend or protrude outwardly from the hanging bar 500 in the inserted position, but do not extend outwardly past the legs 506 so as to not impede movement of the lid 28 to the closed position.

In the extended position, as illustrated, at least one of the extendable portions 515 extends outwardly from the hanging bar 500 to provide additional functional length for the hanging bar 500 and to increase the surface area for hanging laundry items on the hanging bar 500. In one example, the extendable portions 515 telescope outwardly from within the hanging bar 500, and specifically from within the rod 502, to reach the extended position. When the extendable portions 515 telescope outwardly from the hanging bar 500, the extendable portions 515 can extend away from one another, in opposite directions, and outwardly from the hanging bar 500, such as by extending beyond the width of the hanging bar 500 to extend outwardly past the legs 506 and to increase the effective width of the hanging bar 500. In a further example, the extended position of the extendable portions 515 can be defined by both of the extendable portions 515 being withdrawn from the hanging bar 500 to a maximum extent such that the extendable portions 515 cannot be further withdrawn from the hanging bar 500 without entirely removing the extendable portions 515 from the hanging bar 500. However, it will be understood that the hanging bar 500 and the extendable portions 515 are capable of being positioned in a variety of suitable configurations, such as one extendable portion 515 extending from the hanging bar 500 while the other extendable portion 515 remains in the inserted position, or any other suitable combination or degree of insertion or withdrawal of neither, one, or both of the extendable portions 515.

Turning to the operation, when the user desires additional hanging space from the hanging bar 500, the user can withdraw the extendable portions 515 into the extended position simply by gripping the portion or the end of the extendable portions 515 that protrudes through and beyond the open ends 517 so as to be grasped and withdrawn by the user. In one example, the extendable portions 515 can include a gripping portion or an end cap for ease of withdrawal by the user. The user can then withdraw one or both of the extendable portions 515 to the extent desired for hanging additional laundry items. When the extendable portions 515 are no longer needed, the user can simply push inwardly on the extendable portions 515 to re-insert them within the hanging bar 500. It will be understood that a variety of actuating mechanisms can be coupled with the extendable portions 515, such that the extendable portions 515 may be automatically provided to the extended position, such as by biasing or other actuation. In one example, a mechanism can be included such that the extendable portions 515 are automatically biased outwardly to the extended position when the hanging bar 500 is moved from the storage position into the use position.

The hanging bar 500 having the extendable portions 515 can be provided in combination with any of the designs, structures, or features described in the present disclosure, such as to be used with any or all of the retaining element 120, the linking elements 140, 240, the biasing assembly 150, the damper 160, the locking assemblies 170, 270, or the breakaway portions 314, 414. Further, the extendable portions 515 are not limited to use with the hanging bar 500, but can be included with any of the hanging bars 100, 200, 300, 400 described herein.

Figure 20:
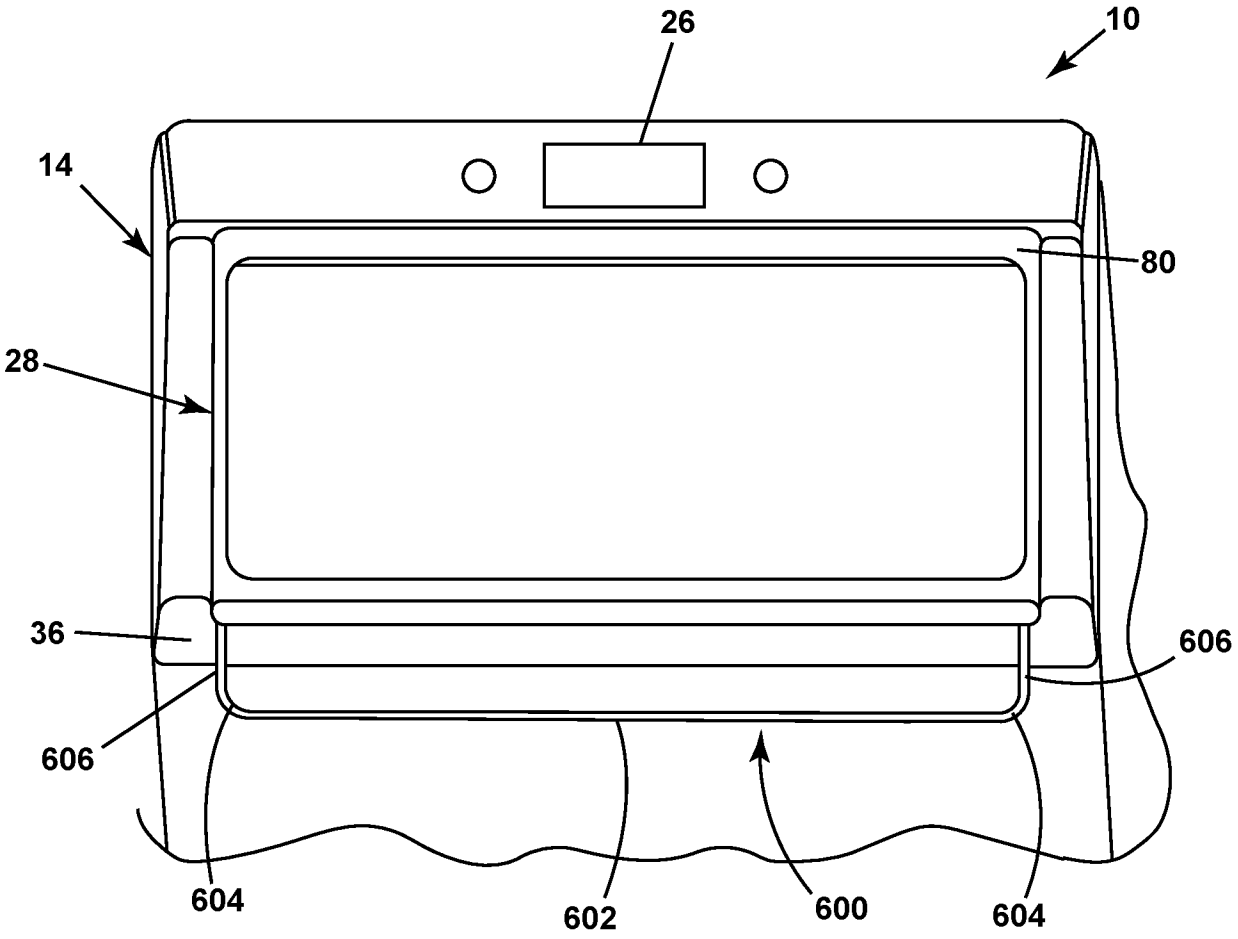
FIG. 20 is a top perspective view of the cover of FIG. 3 in a closed position relative to the cabinet and including another example of a hanging bar that can be provided with the cover of FIG. 3, with the hanging bar in the use position.

Referring now to FIG. 20, another example of a hanging bar 600 for use with the lid 28 is shown in a use position. The hanging bar 600 is similar to the hanging bar 100 and shares many of the same features and components as the hanging bar 100, but differs in some aspects, such as the position and configuration of at least the use position. Therefore, elements of the hanging bar 600 that are similar to those of the hanging bar 100 are identified with numerals increased by 500, with it being understood that the description of the like parts of the hanging bar 100 applies to the hanging bar 600, unless otherwise noted.

The hanging bar 600 comprises a rod 602 having opposing ends 604 with a leg 606 extending from each of the opposing ends 604. The legs 606 can be movably coupled, such as rotatably coupled, relative to the lid 28 for movement of the hanging bar 600 between the storage position and the use position, and specifically can each be rotatably coupled to the second end 144 of a different one of the linking elements 140, as with the hanging bar 100. By way of non-limiting example, each of the legs 606 can be movably coupled directly to the second end 144 of the different one of the linking elements 140, or one coupling element 108 can be provided between each leg 606 and the lid 28 to at least partially receive and to movably couple each leg 606 relative to the lid 28, as in the case of the hanging bar 100. While each leg 606 is described herein as optionally coupled to the lid 28 via one of the coupling elements 108, it will be understood that each leg 606 can instead be coupled directly to the second end 144 of one of the linking elements 140, with no coupling element 108 provided, or, alternatively, that any of the other suitable coupling elements 108, 208, 308, 408 as described herein can be provided and need not be limited to the coupling elements 108 provided with the hanging bar 100.

In one example, the hanging bar 600 can even have a structure that is identical to or very similar to the hanging bar 100, the hanging bar 600 differing instead from the hanging bar 100 in terms of placement and positioning, such as between the storage position and the use position. In the storage position, the hanging bar 100 extends along and is provided adjacent to, such as parallel to, and confronting the inner surface 82, and can further overlie the treating chamber 32 and the access opening 15 in the storage position, whether the lid 28 is in the closed or the opened position. In the storage position (not shown), the hanging bar 600 can be configured similarly to the storage positions of the hanging bars 100, 200, 300, 400, 500, such that the hanging bar 600 is received within the laundry treating appliance 10 and not accessible by a user when the hanging bar 600 is in the storage position and the lid 28 is in the closed position. Further similarly to the hanging bars 100, 200, 300, 400, 500, the hanging bar 600 can extend along, such as by being parallel to, and confront the inner surface 82 of the lid 28 in the storage position. Further still, the hanging bar 600 can at least partially overlie the treating chamber 32 and the access opening 15 in the storage position.

However, while the hanging bar 600 can have significant overlap with at least the hanging bar 100 in terms of structure and of position and configuration in the storage position, the hanging bar 600 differs from the hanging bar 100 with respect to the placement, position, and configuration of the hanging bar 600 in at least the use position, such as relative to the cabinet 14, the access opening 15, the lid 28, and the treating chamber 32. The hanging bar 100 extends outwardly, such as orthogonally, from the lid 28 to overlie the treating chamber 32 and the access opening 15 in the use position and with the lid 28 in the opened position. Further, in addition to the hanging bar 100, all of the hanging bars 100, 200, 300, 400, 500 previously described herein can have a use position wherein the hanging bars 100, 200, 300, 400, 500 extend outwardly, such as orthogonally, from the lid 28 in the use position, and extend along and confront the inner surface 82 of the lid 28 in the storage position. In addition, the hanging bars 100, 200, 300, 400, 500 may be configured or intended for occupying the use position when the lid 28 is in the opened position and, in some examples, can only be moved into the use position when the lid 28 is in the opened position.

The hanging bar 600 instead can be positioned and configured so as to achieve a different arrangement of the components of the laundry treating appliance 10 when the hanging bar 600 is in the use position, as compared to the hanging bars 100, 200, 300, 400, 500. Further in contrast with the hanging bars 100, 200, 300, 400, 500 previously described, the hanging bar 600 can occupy the use position even when the lid 28 is in the closed position. Further still, the hanging bar 600 in the use position is also accessible by the user when the lid 28 is in the closed position, such as even during a cycle of operation of the laundry treating appliance 10. In one example, and as illustrated herein, the hanging bar 600 is provided such that it is accessible at an exterior of the laundry treating appliance 10 and the cabinet 14 when the hanging bar 600 is in the use position and the lid 28 is in the closed position.

As shown, the hanging bar 600 is in the use position and is positioned at least partially outside or exterior to the laundry treating appliance 10 with the lid 28 in the closed position. Specifically, while the previously described hanging bars 100, 200, 300, 400, 500 extend outwardly, such as orthogonally, from the lid 28 in the use position, and further to overlie the treating chamber 32 and the access opening 15, the hanging bar 600 instead is positioned away from the treating chamber 32 and the access opening 15 in the use position. The hanging bar 600, in fact, extends from the lid 28 in a direction directly away from the treating chamber 32 and the access opening 15. In the use position, the hanging bar 600 extends away from the treating chamber 32 and the access opening 15, and in particular, such that the hanging bar 600 extends outwardly away from a periphery of the treating chamber 32 and of the access opening 15.

Continuing further, the hanging bar 600 extends past or beyond the periphery of the lid 28 occupying the closed position to overlie and extend along the cabinet 14, and in particular the top panel 36 of the cabinet 14. The hanging bar 600 extends further beyond a periphery of the cabinet 14, and in particular extends far enough beyond the periphery of the cabinet 14 such that the distance the hanging bar 600 extends beyond the cabinet 14 is sufficient for laundry items hung on the hanging bar 600 to be able to hang freely and not contact, abut, or overlie the cabinet 14. In this use position, with the extent to which the hanging bar 600 extends beyond the cabinet 14, at least a portion of the hanging bar 600 is positioned such that it does not overlie the cabinet 14. While a portion of the hanging bar 600 in the use position may extend along the cabinet 14 and still overlie the cabinet 14, such as a portion of each of the legs 606 extending from the lid 28 toward the periphery of the cabinet 14, it will be understood that the use position of the hanging bar 600 can be defined such that at least a portion of the hanging bar 600 will not overlie the cabinet 14. Thus, as at least a portion of the hanging bar 600 extends beyond and does not overlie the cabinet 14, the hanging bar 600 can be thought of as not overlying the cabinet 14 in the use position, at least because the hanging bar 600 will not completely or entirely overlie the cabinet 14 in the use position, as well as because an operable portion of the hanging bar 600 that supports laundry items for hanging, namely the rod 602 and the opposing ends 604, does not overlie the cabinet 14 in the use position.

While the hanging bars 100, 200, 300, 400, 500 are provided and configured to overlie the treating chamber 32 and the access opening 15 in the use position, the hanging bar 600 instead extends away from the treating chamber 32 and the access opening 15 such that the hanging bar 600 does not overlie the access opening 15 in the use position. To highlight a further difference, the hanging bars 100, 200, 300, 400, 500 extend orthogonally outwardly from the lid 28 in the use position but confront and extend parallel along the inner surface 82 in the storage position. Rather than extending orthogonally outwardly from the lid 28 in the use position like the hanging bars 100, 200, 300, 400, 500, the hanging bar 600 does extend outwardly from the lid 28, and specifically from the inner surface 82, but extends instead outwardly along the lid 28 and the inner surface 82. Specifically, despite the hanging bar 600 extending beyond the periphery of the lid 28, with the lid 28 in the closed position and the hanging bar 600 in the use position, the hanging bar 600 extends in a plane and direction such that the hanging bar 600 remains substantially parallel with the inner surface 82 and the lid 28 in the use position.

Turning to the operation, the aspects of the hanging bar 600 offer additional flexibility and capabilities to the user that are not provided with the other hanging bars 100, 200, 300, 400, 500. In one example, the hanging bar 600 provides to the user the ability to make use of the hanging bar 600 that can be accessible by the user even when the lid 28 is in the closed position. Even further, the hanging bar 600 can be provided in the use position and accessible by the user not only when the lid 28 is in the closed position, but also even when a cycle of operation is being completed by the laundry treating appliance 10. It is contemplated that a single laundry treating appliance 10 can further include the hanging bar 600, in addition to another hanging bar, such as one of the hanging bars 100, 200, 300, 400, 500. In this way, the user can take advantage of the benefit provided by the hanging bar 600 of being able to utilize the hanging bar 600 even during operation of the laundry treating appliance 10, and can additionally have the option available to further make use of one of the hanging bars 100, 200, 300, 400, 500, which can be used only when the laundry treating appliance 10 is not operating to complete a cycle of operation but adds the benefit of being able to hang laundry items such that they are suspended over the treating chamber 32 for easy capture and control of liquid that may drain from the laundry items.

Actuation of the hanging bar 600 to the use position for hanging laundry items can be accomplished in any suitable manner according to at least the variety of methods and structures discussed in the present disclosure. Although the movement of the hanging bar 600 from the storage position to the use position requires the hanging bar 600 to be actuated in the opposite direction as compared to the hanging bars 100, 200, 300, 400, 500, the disclosures are still applicable such that components can be repositioned or adjusted to effect the appropriate movement. In one example, the positioning of components relative to the periphery of the lid 28, as well as the sizing of the hanging bar 600 and associated components, can be selected to produce the desired movement and cause the hanging bar 600 to reach the intended use position. Additionally, or alternatively, the hanging bar 600 can be actuated by any suitable actuating mechanism or method, non-limiting examples of which include actuating the hanging bar 600 for slidable movement to the use position, by the inclusion of telescoping elements within the hanging bar 600 to extend sufficiently beyond the cabinet 14, by manual actuation of the hanging bar 600 to the use position by the user, by the inclusion of biasing elements, etc.

The hanging bar 600 configured to occupy the use position extending beyond the periphery of the lid 28 and of the cabinet 14 can be provided in combination with any of the designs, structures, or features described in the present disclosure, such as to be used with any or all of the retaining element 120, the linking elements 140, 240, the biasing assembly 150, the damper 160, the locking assemblies 170, 270, or the breakaway portions 314, 414. Further, the provision of the hanging bar 600 in the use position as shown is not limited to use with the hanging bar 600, but can be included with any of the hanging bars 100, 200, 300, 400, 500 described herein.

The aspects of the present disclosure described herein set forth a laundry treating appliance having a cover or lid that can include a hanging bar, providing a convenient place for a user to hang clothing that may be wet or soiled and can then drip into the treating chamber. The hanging bar provided herein includes a number of features for an improved user experience, including that the opening of the hanging bar can be effected by a single-hand actuation, such that the user need only move the lid to the opened position and deflect the retaining element. Once the retaining element has been deflected to release the hanging bar, the hanging bar moves to the use position automatically, and furthermore the locking mechanism engages automatically so the user has peace of mind that the lid will not unintentionally close. In addition, the configuration of the biasing element and the damper further ensure that the hanging bar is actuated to the use position in a soft-open manner, rather than a rough or abrupt movement.

Additionally, a variety of alternative structures and aspects are disclosed and can be used in any suitable combination with one another, providing many opportunities for customization to meet various user needs. In one example, the locking assemblies and their actuation in opposite directions provide locking assemblies that can accommodate a variety of different hinge sizes and configurations for use with a wide variety of laundry treating appliances. The alternative hanging bar aspects allow for further customization, such as to incorporate breakaway portions and to avoid unnecessary stress on the hanging bars, to provide additional telescoping portions for increased laundry item hanging space, and additionally to provide a solution that allows the hanging bar to be used even during operation of the laundry treating appliance.

To the extent not already described, the different features and structures of the various aspects can be used in combination with each other as desired. That one feature may not be illustrated in all of the aspects of the disclosure is not meant to be construed that it cannot be, but is done for brevity of description. Thus, the various features of the different aspects can be mixed and matched as desired to form new aspects, whether or not the new aspects are expressly described. Combinations or permutations of features described herein are covered by this disclosure.

This written description uses examples to disclose aspects of the disclosure, including the best mode, and also to enable any person skilled in the art to practice aspects of the disclosure, including making and using any devices or systems and performing any incorporated methods. While the aspects of the present disclosure have been specifically described in connection with certain specific details thereof, it is to be understood that this is by way of illustration and not of limitation. Reasonable variation and modification are possible within the scope of the forgoing disclosure and drawings without departing from the spirit of the present disclosure, which is defined in the appended claims. Hence, specific dimensions and other physical characteristics relating to the aspects of the present disclosure are not to be considered as limiting, unless expressly stated otherwise.

What is claimed is:

1. A laundry treating appliance for treating laundry items according to an automatic cycle of operation, the laundry treating appliance comprising:

a cabinet defining an interior and having an access opening to the interior;

a cover movable between a closed position and an opened position to selectively open or close the access opening and having an inner surface confronting the access opening when the cover is in the closed position; and a hanging bar having a rod with opposite ends, a leg extending from each end, and the legs movably coupled to the cover for movement of the hanging bar between a storage position, where the hanging bar is adjacent the cover, and a use position, where the hanging bar extends from the cover;

wherein the cover comprises a locking element operably coupled with the hanging bar to prevent the cover from moving from the opened position to the closed position when the hanging bar is in the use position.

2. The laundry treating appliance of claim 1 wherein the legs are rotatably coupled to the cover and define an axis of rotation about which the hanging bar rotates between the storage position and the use position.

3. The laundry treating appliance of claim 1 wherein the hanging bar is biased toward the use position.

4. The laundry treating appliance of claim 3 wherein the cover includes a retaining element retaining the hanging bar in the storage position.

5. The laundry treating appliance of claim 1 wherein the hanging bar confronts the inner surface in the storage position and extends from the inner surface in the use position.

6. The laundry treating appliance of claim 5 wherein the hanging bar is substantially parallel to the inner surface in the storage position.

7. The laundry treating appliance of claim 6 wherein the hanging bar extends substantially orthogonally outward from the inner surface in the use position.

8. The laundry treating appliance of claim 6 wherein the hanging bar extends beyond a periphery of the cover in the use position and remains substantially parallel with the inner surface.

9. The laundry treating appliance of claim 1 wherein the hanging bar at least partially overlies the access opening in at least the use position.

10. The laundry treating appliance of claim 9 wherein the hanging bar at least partially overlies the access opening in the use position when the cover is in the opened position.

11. The laundry treating appliance of claim 1 wherein the hanging bar does not overlie the access opening in the use position.

12. The laundry treating appliance of claim 11 wherein the hanging bar extends beyond and does not overlie the cabinet in the use position.

13. The laundry treating appliance of claim 1 wherein a hinge couples the cover to the cabinet for movement between the closed and opened positions.

14. The laundry treating appliance of claim 13 wherein movement of the hanging bar to the use position moves the locking element to bear against the hinge to prevent the cover from moving to the closed position.

15. The laundry treating appliance of claim 1 wherein the hanging bar comprises at least one extendable portion that telescopes outwardly from within the hanging bar.

16. The laundry treating appliance of claim 1 wherein the hanging bar comprises a breakaway portion allowing the hanging bar to detach from the cover when sufficient force is applied to the hanging bar.

17. The laundry treating appliance of claim 16 wherein the legs comprise the breakaway portion.

18. The laundry treating appliance of claim 1 wherein the cover comprises a peripheral frame and the legs are coupled to the peripheral frame.

19. A laundry treating appliance for treating laundry items according to an automatic cycle of operation, the laundry treating appliance comprising:

a cabinet defining an interior and having an access opening to the interior;

a cover movable between a closed position and an opened position to selectively open or close the access opening and having an inner surface confronting the access opening when the cover is in the closed position; and a hanging bar having a rod with opposite ends, a leg extending from each end, and the legs rotatably mounted to the cover for rotational movement of the hanging bar between a storage position, where the hanging bar is adjacent the cover, and a use position, where the hanging bar extends from the cover, and wherein the hanging bar comprises at least one extendable portion.

20. A laundry treating appliance for treating laundry items according to an automatic cycle of operation, the laundry treating appliance comprising:

a cabinet defining an interior and having an access opening to the interior;

a cover movable between a closed position and an opened position to selectively open or close the access opening and having an inner surface confronting the access opening when the cover is in the closed position; and a hanging bar having a rod with opposite ends, a leg extending from each end, and the legs movably coupled to the cover for movement of the hanging bar between a storage position, where the hanging bar is adjacent the cover, and a use position, where the hanging bar extends from the cover, and wherein the hanging bar comprises at least one extendable portion selectively outwardly extendable from one of the opposite ends of the hanging bar, to extend beyond the width of the hanging bar and past the leg.

* * * * *